US009058924B2

(12) United States Patent
Komatsu et al.

(10) Patent No.: US 9,058,924 B2
(45) Date of Patent: Jun. 16, 2015

(54) MAGNETIC CARRIER AND TWO-COMPONENT DEVELOPER

(71) Applicant: CANON KABUSHIKI KAISHA, Tokyo (JP)

(72) Inventors: Nozomu Komatsu, Toride (JP); Kentaro Kamae, Kashiwa (JP); Koh Ishigami, Abiko (JP); Yoshinobu Baba, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/902,365

(22) Filed: May 24, 2013

(65) Prior Publication Data

US 2014/0030650 A1 Jan. 30, 2014

(30) Foreign Application Priority Data

May 28, 2012 (JP) ..... 2012-121361

(51) Int. Cl.

| | |
|---|---|
| ***G03G 9/107*** | (2006.01) |
| ***H01F 1/01*** | (2006.01) |
| ***G03G 9/083*** | (2006.01) |
| ***G03G 9/113*** | (2006.01) |

(52) U.S. Cl.

CPC ..... *H01F 1/01* (2013.01); *G03G 9/0833* (2013.01); *G03G 9/107* (2013.01); *G03G 9/1075* (2013.01); *G03G 9/1131* (2013.01)

(58) Field of Classification Search

CPC ..... G03G 9/0833; G03G 9/107
USPC ..... 430/111.32, 111.35
See application file for complete search history.

(56) References Cited

U.S. PATENT DOCUMENTS

| | | | |
|---|---|---|---|
| 5,340,677 | A | 8/1994 | Baba et al. |
| 5,439,771 | A | 8/1995 | Baba et al. |
| 5,464,720 | A | 11/1995 | Baba et al. |
| 5,470,687 | A | 11/1995 | Mayama et al. |
| 5,494,770 | A | 2/1996 | Baba et al. |
| 5,573,880 | A | 11/1996 | Mayama et al. |
| 5,576,133 | A | 11/1996 | Baba et al. |
| 5,712,069 | A | 1/1998 | Baba et al. |
| 5,744,278 | A | 4/1998 | Ayaki et al. |

(Continued)

FOREIGN PATENT DOCUMENTS

| | | | |
|---|---|---|---|
| JP | 2010-39368 | A | 2/2010 |
| JP | 2010-61120 | A | 3/2010 |
| JP | 2010-281892 | A | 12/2010 |

OTHER PUBLICATIONS

Naka, et al., U.S. Appl. No. 13/952,252, filed Jul. 26, 2013.

(Continued)

*Primary Examiner* — Thorl Chea

(74) *Attorney, Agent, or Firm* — Fitzpatrick, Cella, Harper & Scinto

(57) ABSTRACT

A magnetic carrier having a resin-containing ferrite particles each containing a porous ferrite core and a resin in pores of the porous ferrite core, wherein the porous ferrite core has a particular pore diameter corresponding to the maximum logarithmic differential pore volume in a pore diameter range from at least 0.10 μm to not more than 3.00 μm, the resistivity of the porous ferrite core is in a particular range, and the porous ferrite core contains an oxide of Mg in a particular amount and contains a particular amount of a oxide of at least one metal selected from the group consisting of Mn, Sr, and Ca.

3 Claims, 3 Drawing Sheets

(56) References Cited

U.S. PATENT DOCUMENTS

| | | | |
|---|---|---|---|
| 5,766,814 | A | 6/1998 | Baba et al. |
| 5,789,132 | A | 8/1998 | Mayama et al. |
| 5,985,502 | A | 11/1999 | Ayaki et al. |
| 6,010,811 | A | 1/2000 | Baba et al. |
| 6,083,655 | A | 7/2000 | Itabashi et al. |
| 6,106,990 | A | 8/2000 | Tazawa et al. |
| 6,124,070 | A | 9/2000 | Baba et al. |
| 6,159,648 | A | 12/2000 | Baba et al. |
| 6,165,663 | A | 12/2000 | Baba et al. |
| 6,358,658 | B1 | 3/2002 | Tazawa et al. |
| 6,566,028 | B2 | 5/2003 | Itabashi et al. |
| 6,751,424 | B2 | 6/2004 | Komatsu et al. |
| 6,808,852 | B2 | 10/2004 | Hotta et al. |
| 6,905,808 | B2 | 6/2005 | Itakura et al. |
| 7,022,449 | B2 | 4/2006 | Sugahara et al. |
| 7,112,395 | B2 | 9/2006 | Ida et al. |
| 7,138,213 | B2 | 11/2006 | Itakura et al. |
| 7,144,668 | B2 | 12/2006 | Baba et al. |
| 7,229,727 | B2 | 6/2007 | Itakura et al. |
| 7,244,539 | B2 | 7/2007 | Baba et al. |
| 7,279,262 | B2 | 10/2007 | Fujikawa et al. |
| 7,288,348 | B2 | 10/2007 | Hayami et al. |
| 7,300,733 | B2 | 11/2007 | Sugahara et al. |
| 7,361,441 | B2 | 4/2008 | Itakura et al. |
| 7,396,626 | B2 | 7/2008 | Fujikawa et al. |
| 7,396,629 | B2 | 7/2008 | Baba et al. |
| 7,452,647 | B2 | 11/2008 | Hayami et al. |
| 7,611,813 | B2 | 11/2009 | Ida et al. |
| 7,629,100 | B2 | 12/2009 | Okamoto et al. |
| 7,767,370 | B2 | 8/2010 | Ishigami et al. |
| 7,858,283 | B2 | 12/2010 | Ishigami et al. |
| 7,906,262 | B2 | 3/2011 | Ishigami et al. |
| 7,927,775 | B2 | 4/2011 | Komatsu et al. |
| 7,939,233 | B2 | 5/2011 | Inoue et al. |
| 8,084,174 | B2 | 12/2011 | Hasegawa et al. |
| 8,114,562 | B2 | 2/2012 | Ishigami et al. |
| 8,137,886 | B2 | 3/2012 | Baba et al. |
| 8,142,972 | B2 | 3/2012 | Hotta et al. |
| 8,288,069 | B2 | 10/2012 | Fujikawa et al. |
| 8,298,742 | B2 | 10/2012 | Okamoto et al. |
| 8,323,726 | B2 | 12/2012 | Naka et al. |
| 2010/0028796 | A1* | 2/2010 | Nakamura et al. ..... 430/110.3 |
| 2010/0183971 | A1 | 7/2010 | Fujikawa et al. |
| 2010/0248126 | A1 | 9/2010 | Ishigami et al. |
| 2010/0273103 | A1 | 10/2010 | Baba et al. |
| 2010/0310978 | A1 | 12/2010 | Endo et al. |
| 2011/0097661 | A1 | 4/2011 | Ishigami et al. |
| 2011/0129772 | A1* | 6/2011 | Iwata et al. ..... 430/108.6 |
| 2012/0214097 | A1 | 8/2012 | Naka et al. |
| 2013/0171556 | A1 | 7/2013 | Fujikawa et al. |
| 2013/0196265 | A1 | 8/2013 | Kamae et al. |
| 2013/0244159 | A1 | 9/2013 | Ishigami et al. |
| 2013/0244164 | A1 | 9/2013 | Fujikawa et al. |
| 2013/0288173 | A1 | 10/2013 | Hashimoto et al. |
| 2013/0288174 | A1 | 10/2013 | Shiotari et al. |
| 2013/0316282 | A1 | 11/2013 | Ishigami et al. |

OTHER PUBLICATIONS

Baba, et al., U.S. Appl. No. 13/961,593, filed Aug. 7, 2013.

* cited by examiner

MAGNETIC CARRIER AND TWO-COMPONENT DEVELOPER

BACKGROUND OF THE INVENTION

1. Field of the Invention

The present invention relates to a magnetic carrier and a two-component developer that are used in electrophotographic systems, electrostatic recording systems, and electrostatic printing systems.

2. Description of the Related Art

The developing systems used in, for example, electrophotography, include monocomponent developing systems, which use only toner, and two-component developing systems, which use a mixture of toner with a magnetic carrier.

Two-component developing systems, because they use a magnetic carrier, have an excellent ability to triboelectrically charge the toner and offer the advantages over monocomponent developing systems of more stable charging characteristics and better long-term maintenance of a high image quality. In addition, two-component developing systems provide an excellent performance with regard to supplying toner to the developing zone and in particular are frequently used in, for example, high-speed copiers.

For example, a heavy metal-containing ferrite carrier has been used as this magnetic carrier. However, the high density and large saturation magnetization that occur in this case result in a rigid magnetic brush, and as a consequence deterioration of the developer, i.e., the generation of spent carrier and external additive deterioration for the toner, is prone to occur.

An Mg-type ferrite carrier with a low specific gravity has been introduced as a result. However, when the saturation magnetization of an Mg-type ferrite is increased, the resistance then declines and as a consequence it has been quite difficult to optimize both the magnetization and the resistance.

For example, an Mg-type ferrite carrier that substantially does not use heavy metal, including Mn, is provided in Japanese Patent Application Laid-open No. 2010-39368. Due to the use of a prescribed Ti content, this carrier exhibits a suitable unevenness in the carrier surface and achieves stable charging characteristics and longer life.

In addition, due to its use of a prescribed Mn content, the carrier provided in Japanese Patent Application Laid-open No. 2010-281892 strikes a balance between magnetization and resistance by controlling the grain structure within the ferrite core and can inhibit carrier scattering.

By stabilizing charging through an optimization of the magnetization and resistance, these proposals have provided excellent images when used in low-speed devices. However, the developing performance has been inadequate when used in high-speed devices (50 sheets/minute or more) and during durability testing the image density has undergone variation and/or blank dots have been produced.

Various carriers having a reduced specific gravity brought about by filling a resin into a porous ferrite core have also been proposed. The proposal is made in Japanese Patent Application Laid-open No. 2010-61120 that carrier adhesion can be inhibited—even during image printing at low image ratios—by using a carrier provided by controlling the pore diameter in ferrite core particles as measured by the mercury intrusion method. However, the amount of charge on the toner readily assumes excessive levels in high-speed devices and there is still room for improvement.

SUMMARY OF THE INVENTION

The present invention provides a magnetic carrier and a two-component developer that exhibit a stable charge-providing performance on a long-term basis even under high-stress conditions of use, for example, in a high-speed copier. The present invention also provides a magnetic carrier and a two-component developer that can inhibit the generation of blank dots in a low-humidity environment.

As a result of extensive and intensive investigations, the present inventors discovered that a magnetic carrier that exhibits a stable charge-providing performance on a long-term basis even under high-stress conditions of use, for example, in a high-speed copier, is obtained by controlling the pore diameter distribution of an Mg-type ferrite core particle containing a prescribed amount of at least one oxide selected from Mn, Sr, and Ca.

Thus, the present invention relates to a magnetic carrier comprising resin-containing ferrite particles each comprising a porous ferrite core having pores and a resin contained in the pores of the porous ferrite core, wherein, in a pore diameter distribution of the pores measured by using a mercury intrusion method, a pore diameter at which a logarithmic differential pore volume shows the maximum value in the pore diameter range of from at least 0.10 μm to not more than 3.00 μm, is present within the pore diameter range of from at least 0.80 μm to not more than 1.50 μm, the porous ferrite core i) has a resistivity for the porous ferrite core at 100 V/cm of from at least $8.0\times10^4$ Ω·cm to not more than $1.0\times10^6$ Ω·cm, ii) contains an oxide of Mg in the range from at least 1.00 mass % to not more than 15.00 mass % as MgO with reference to a mass of the porous ferrite core, and iii) contains a metal oxide, the metal being at least one metal selected from the group consisting of Mn, Sr, and Ca, and a total content of the metal oxide as MnO, SrO and CaO is from at least 0.02 mass % to not more than 1.50 mass % with reference to a mass of the porous ferrite core.

The present invention further relates to a two-component developer that comprises at least a toner and the above-described magnetic carrier.

Image density variations can be prevented because the magnetic carrier according to the present invention has a stable charge-providing performance on a long-term basis even under high-stress conditions of use, for example, in a high-speed copier. The generation of blank dots in a low-humidity environment can also be inhibited.

DESCRIPTION OF THE PREFERRED EMBODIMENTS

Figure 1:
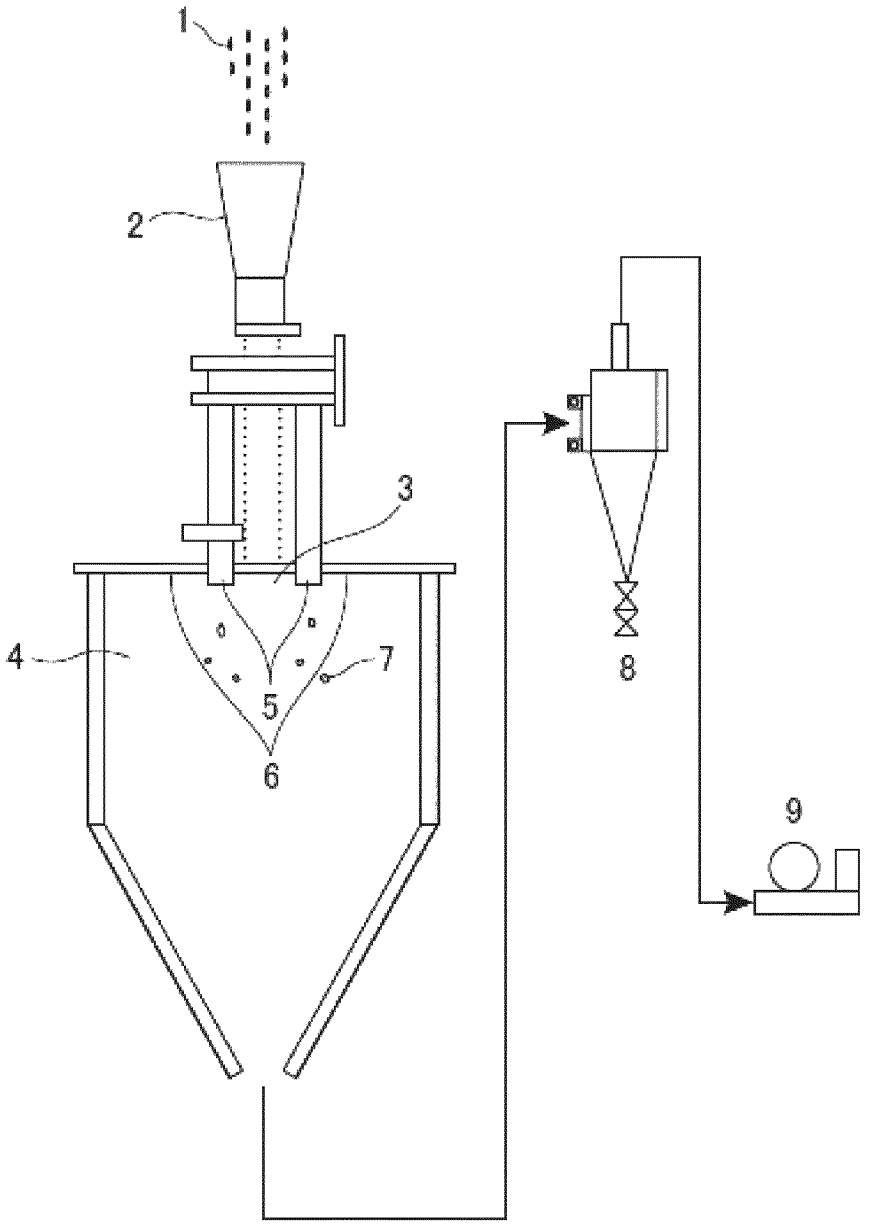
FIG. 1 is a schematic cross-sectional diagram of a surface-treatment apparatus for the toner used by the present invention.

Embodiments of the present invention are described in detail in the following.

The magnetic carrier of the present invention is a magnetic carrier comprising resin-containing ferrite particles, each of which contains a porous ferrite core and a resin in the pores of the porous ferrite core.

A porous ferrite core is the same as a porous ferrite core particle in the present invention.

Similarly, a magnetic carrier is the same as a magnetic carrier particle.

In its pore diameter distribution of the pores measured by using a mercury intrusion method, this porous ferrite core (also referred to as a porous ferrite core particle herebelow) has a pore diameter of from at least 0.80 μm to not more than 1.50 μm and preferably from at least 1.00 μm to not more than 1.45 μm corresponding to the maximum logarithmic differential pore volume in the pore diameter range of from at least 0.10 μm to not more than 3.00 μm. A stable image that presents little density variation is obtained—even during long-term use under high-stress conditions of use, e.g., in a high-speed copier—by having the pore diameter at which the logarithmic differential pore volume forms a maximum be in the indicated range.

The value measured by mercury intrusion methods will now be considered. In a mercury intrusion method, the volume (V) of mercury penetrating into the pores is measured while varying the pressure applied to the mercury. The relationship $PD=-4\sigma \cos\theta$ obtains between the pressure and the pore diameter into which mercury has intruded, where P is the pressure, D is the pore diameter, and θ and σ are, respectively, the contact angle and surface tension of the mercury. Assuming constant values for the contact angle and surface tension, the pressure P is then inversely proportional to the pore diameter D into which the mercury can intrude at P. As a consequence, the pore diameter distribution can be acquired by building a P-V curve by measuring, at different pressures, the pressure P and the volume V of mercury intruded at P and converting the P on the horizontal axis of this P-V curve directly to the pore diameter using the aforementioned relational expression. The pore diameter distribution in the present invention represents the relationship between pore size and the volume thereof. The assumptions are made here that all the pores have a cylindrical shape and that the pore diameter D is expressed by the diameter D. The present invention uses the logarithmic (log) differential pore volume distribution [dV/d(log D)]. Here, the value obtained by dividing the pore volume difference dV, which represents the increment in the pore volume between measurement points, by the difference in the logarithm of the pore diameter or d(log D), is plotted against the interval average pore diameter for each interval. The pore diameter at which the value of the logarithmic differential pore volume passes through a maximum is then determined from the resulting plot.

Mercury intrusion methods can measure the mesopores to the macropores present in a porous ferrite core.

That the pore diameter at which the logarithmic differential pore volume shows the maximum value in the pore diameter range from at least 0.10 μm to not more than 3.00 μm in the pore diameter distribution of the pores measured by mercury intrusion method is not more than 1.50 μm means that the pores in the porous ferrite core particle are densely present. Such a porous ferrite core particle also presents little decline in strength in comparison to a core that lacks pores. This makes it possible, even under high-stress conditions of use, e.g., in a high-speed copier, to inhibit fracture of the magnetic carrier and to maintain a stable charge-providing performance on a long-term basis.

In addition, by having the pore diameter at which the logarithmic differential pore volume shows the maximum value be at least 0.80 μm, a favorable unevenness can be induced in the surface of the porous ferrite core particle and strong bonding between the resin and the porous ferrite core particle can be brought about. As a consequence, even in a high-stress scenario separation of the resin from the porous ferrite core particle can be diminished and changes in the charge-providing performance can be inhibited over the long term.

When this pore diameter corresponding to the maximum logarithmic differential pore volume is larger than 1.50 μm, the three-dimensional structure of the porous ferrite then becomes so open that the strength of the porous ferrite core particle cannot be maintained. As a consequence, it may not be possible to prevent a reduction in the strength of the magnetic carrier and the carrier may then be ruptured. In addition, when the pore diameter that provides the maximum logarithmic differential pore volume is less than 0.80 μm, the unevenness in the surface of the porous ferrite core particle then becomes too small and the bonding area between the resin and the porous ferrite core particle will be small as a result and separation of the resin will be produced. In both of these cases, variations in the charge-providing performance of the magnetic carrier are also facilitated and large variations in image density will occur during long-term use under high-stress conditions of use, e.g., in high-speed copiers.

The resistivity at 100 V/cm of the porous ferrite core used by the present invention is from at least $8.0\times10^4$ Ω·cm to not more than $1.0\times10^6$ Ω·cm and preferably is from at least $1.0\times10^5$ Ω·cm to not more than $8.0\times10^5$ Ω·cm. When this range is obeyed, the developing performance during high-speed development, e.g., in a high-speed copier, can be ensured and specifically the production of blank dots in a low-humidity environment can be inhibited. When the resistivity of the porous ferrite core at 100 V/cm is less than $8.0\times10^4$ Ω·cm, charge leakage from the developer bearing member to the electrostatic latent image bearing member is produced through carrier naps on the developer bearing member and the electrostatic latent image and/or toner image is then disturbed and roughness is readily produced.

When the toner separates from the magnetic carrier during the developing step, a countercharge having the opposite triboelectric charge polarity from the toner remains on the magnetic carrier. When the resistivity of the porous ferrite core at 100 V/cm is higher than $1.0\times10^6$ Ω·cm, the ability of this countercharge to smoothly transfer to the developer bearing member is impaired. When the countercharge accumulates on the magnetic carrier, the Coulomb force between the magnetic carrier and toner grows large and separation of the toner from the magnetic carrier may then be impeded and the development efficiency may decline. In addition, when an image is printed in which a solid area is adjacent to a halftone, the toner development of the halftone in the region adjacent to the solid area is impaired due to the edge effect. As a consequence, development may be produced in which the density of the halftone image is reduced (blank dots).

In order to prevent this development, the countercharge of opposite triboelectric charge polarity from the toner that remains on the magnetic carrier must be smoothly transferred through the magnetic carrier to the developer bearing member. This serves to eliminate the toner-return force and to provide an excellent developing performance.

However, the simple use of a carrier particle having a low-resistance core particle has still resulted in disturbances in the toner image and/or electrostatic latent image present on the electrostatic latent image bearing member. The cause here is as follows: due to the low resistance of the core particle, charge leaks—via carrier naps on the developer bearing member—from the developer bearing member to the electrostatic latent image bearing member and the electrostatic latent image and/or toner image is then disturbed.

By providing the ferrite core with a porous structure, leakage between the developer bearing member and the electrostatic latent image bearing member can be inhibited while the countercharge undergoes smooth transfer to the developer bearing member. However, as the pores present in the ferrite core become more numerous, obtaining a satisfactory magnetization becomes more difficult and the appearance of carrier scattering has occurred. Thus, the porous ferrite core used by the present invention must exhibit a low resistance and must have a high magnetization.

The porous ferrite core in the present invention therefore contains an oxide of Mg in the range from at least 1.00 mass % to not more than 15.00 mass % as MgO with reference to the mass of the porous ferrite core. At the same time, it is essential that the porous ferrite core contain an oxide of at least one metal selected from the group consisting of Mn, Sr, and Ca and that the total content of this metal oxide as MnO, SrO and CaO be from at least 0.02 mass % to not more than 1.50 mass % with reference to the mass of the porous ferrite core.

The porous ferrite core in the present invention preferably contains an oxide of Mg from at least 5.00 mass % to not more than 13.00 mass % as MgO with reference to the mass of the porous ferrite core and at the same time this porous ferrite core preferably contains the oxide of at least one metal selected from the group consisting of Mn, Sr, and Ca with the total content of this oxide being from at least 0.20 mass % to not more than 1.00 mass % as MnO, SrO and CaO with reference to the mass of the porous ferrite core.

The resistance declines when the saturation magnetization is raised in an Mg-type ferrite capable of providing a reduced specific gravity, and as a consequence optimizing both the magnetization and resistance has been a problem and various investigations have been carried out in this regard. The present invention, by exploiting this property, brings about a lower resistance while at the same time inducing a high magnetization in the Mg-type ferrite. When this was done, the appearance of carrier scattering and blank dots could be inhibited by at the same time avoiding an excessively low resistance by having a particular content of an oxide of at least one metal selected from the group consisting of Mn, Sr, and Ca.

While the reasons for this are not clear, the present inventors hold as follows.

The $Fe_2O_3$ that is the main component of the ferrite component exhibits a slow sintering rate and undergoes crystallization gradually. In contrast to this, the Mg, because it undergoes crystallization from a low temperature region, exhibits a high sintering rate and crystallizes very rapidly. This works against the presence of Mn, Sr, and Ca in the interior of the Mg-containing grain and they are forced into the vicinity of the grain boundary. In addition, the Mg, which crystallizes early on, raises the magnetization and lowers the resistance in the interval prior to $Fe_2O_3$ crystal growth. As a result, a grain is formed in which the circumference of the grain of resistance-lowering Mg is surrounded by a very thin layer of high resistance Mn, Sr, and Ca ferrite. In addition, crystal growth of the Mg grain is inhibited because Mn, Sr, and Ca are present in the vicinity of the grain boundary and the ferrite core then exhibits a favorably low resistance. It is thought that as a result the ferrite core particle, in combination with its porous structure, does not have an excessively low resistance and carrier scattering and the generation of blank dots can be prevented.

When the Mg is present at less than 1.00 mass % as the oxide with reference to the mass of the porous ferrite core, the Mg ferrite layer is then small and almost only magnetite ($Fe_2O_3$) is present and a low resistance occurs. In addition, when the total content of oxide of at least one metal selected from the group consisting of Mn, Sr, and Ca is less than 0.02 mass % as the oxide, the high-resistance layer does not form to a satisfactory extent at the grain boundary and a low resistance occurs.

When the Mg is present at more than 15.00 mass % as the oxide with reference to the mass of the porous ferrite core, the difference in the sintering rates becomes overly large and the structure of the porous ferrite core particle tends toward coarseness and a high resistance occurs. When the total content of oxide of at least one metal selected from the group consisting of Mn, Sr, and Ca is more than 1.50 mass % as the oxide, a large high-resistance layer forms at the grain boundary and a high resistance occurs. In addition, the Mn, Sr, and Ca ferrite layer may result in excessive toner charging in a low-humidity environment. In particular, a reduced image density can occur in the case of long-term output at a low image ratio (image ratio of not more than 5%).

The pore volume in the pore diameter range from at least 0.10 μm to not more than 3.00 μm in the pore diameter distribution of the pores measured by mercury intrusion method on the porous ferrite core is preferably from at least 0.04 mL/g to not more than 0.10 mL/g and even more preferably is from at least 0.05 mL/g to not more than 0.08 mL/g. When the pore volume is in the indicated range, a more stable charge-providing performance is obtained and a more stable image density is obtained even in the case of the continuous output of a mixture of low image ratio (image ratio of not more than 5%) and high image ratio (image ratio of at least 50%) images.

During the continuous output of a mixture of low image ratio and high image ratio images, large differences occur in the amount of toner replenishment and large variations also readily occur in the toner concentration of the developer. Due to this, if the carrier is unable to continually execute a prescribed charge-providing performance with respect to the newly supplied toner, variations in the image density will also be prone to occur when the toner concentration varies.

Because the magnetic carrier of the present invention contains a resin in the pores of the porous ferrite core, a resin portion and a ferrite portion, which have substantially different specific gravities, are both present in the interior of the carrier. As a consequence, at too much coarser than the desired structure, a weight-based segregation is produced due to the specific gravity difference in the interior and the flowability of the carrier is degraded and the mixability with the toner is diminished and the ability to provide a prescribed charge may be impaired. When the pore volume is in the range indicated above, this provides a porous structure having a low specific gravity and favorable pores and the stress exerted on the carrier and developer is readily lowered. In addition, due to the low weight segregation in the interior of the carrier, the flowability is stable and it becomes possible to always provide a prescribed charge to the toner.

In addition, letting P1 in the pore diameter distribution of the pores measured by mercury intrusion method on the porous ferrite core be the maximum value of the logarithmic differential pore volume in the pore diameter range of from at least 0.80 μm to not more than 1.50 μm and letting P2 be the minimum value of the logarithmic differential pore volume in the pore diameter range of from at least 2.00 μm to not more than 3.00 μm, P1 is preferably from at least 0.07 mL/g to not more than 0.35 mL/g and P2/P1, which is provided by dividing P2 by P1, is preferably from at least 0.05 to not more than 0.35. More preferably, P1 is from at least 0.12 mL/g to not more than 0.30 mL/g and P2/P1 is from at least 0.10 to not more than 0.30.

When P2/P1 is in the range indicated above, the variation or scatter in the charge-providing performance of the resin-containing ferrite particle becomes even smaller and the in-plane uniformity of the image density is then increased still further.

P1 is the maximum value of the logarithmic differential pore volume at pore diameters from at least 0.80 μm to not more than 1.50 μm. As previously noted, the porous ferrite core used in the present invention has a high-strength structure in which pores smaller than a pore diameter of 1.50 μm are numerous and are densely three-dimensionally combined. Thus, the bonding strength between grains can be raised by filling the voids (pores) in this structure with at least a prescribed amount of resin and thereby surrounding the grains with resin.

When P1 is in the range indicated above, the resin can be securely and thoroughly filled into the pores present in the porous ferrite core and a magnetic carrier resistant to stress is formed. Due to this, the resin is preferably uniformly filled into the pores having a pore diameter of from at least 0.80 μm to not more than 1.50 μm. However, these pores with pore diameters of from at least 0.80 μm to not more than 1.50 μm are strongly affected by surface tension and are difficult to wet and in some instances the resin may not fill into these pores. Therefore, pores having a pore diameter of from at least 2.00 μm to not more than 3.00 μm, where there is little effect due to the surface tension, must be present in at least a certain prescribed amount.

When P2/P1 is from at least 0.05 to not more than 0.35, the resin solution first wets and fills the porous ferrite core in the pore fraction from at least 2.00 μm to not more than 3.00 μm. The resin also uniformly fills the pores smaller than 2.00 μm and the magnetic carrier particle can then have a uniform charge-providing performance at any location on the surface.

The pore diameter corresponding to the maximum logarithmic differential pore volume, P1, and P2/P1 can be controlled by changing the particle diameter and particle diameter distribution of the slurry during fabrication of the porous ferrite core and by changing the sintering temperature and time during the main sintering step. This will be described more particularly in the section on the method of producing the magnetic carrier.

The porous ferrite core can be produced using the steps described in the following.

The term "ferrite" refers to a sintered compact represented by the following formula.

$$(M1_2O)_x(M2O)_y(Fe_2O_3)_z$$

(In the formula, M1 is a monovalent metal; M2 is a divalent metal; and, when $x+y+z=1.0$, x and y are each $0 \leq (x, y) \leq 0.8$ and z is $0.2<z<1.0$.)

At least one species of metal atom selected from the group consisting of Li, Fe, Mg, Mn, Sr, and Ca is preferably used as the M1 and M2 in the preceding formula.

Viewed from the standpoint of enabling facile control of the crystal growth rate and enabling favorable control of the pore diameter distribution of the pores of the porous ferrite core, in addition at least one species of metal atom selected from the group consisting of Mn, Sr, and Ca is present in the above-stipulated range in the present invention in the Mg element-containing Mg-type ferrite. A process for producing the porous ferrite core (particle) is described in detail in the following, but there is no limitation to this.

<Step 1 (Weighing/Mixing Step)>

The starting materials for the ferrite under consideration are weighed out and mixed.

The starting materials for the ferrite can be exemplified by the following: metal particles of Li, Fe, Mn, Mg, Sr, Ca, and rare-earth metals as well as their oxides, hydroxides, oxalates, and carbonates. The apparatus for pulverizing/mixing these ferrite starting materials can be exemplified by the following: ball mills, planetary mills, Giotto mills, and vibrating mills. Ball mills are particularly preferred in terms of mixing performance. Specifically, the weighed-out ferrite starting materials and the balls are introduced into a ball mill and pulverization/mixing are performed from at least 0.1 hour to not more than 20.0 hours.

<Step 2 (Presintering Step)>

The pulverized/mixed ferrite starting materials are presintered in air for from at least 0.5 hour to not more than 5.0 hours in a sintering temperature range of from at least 700° C. to not more than 1000° C. in order to carry out ferritization. For example, an oven or furnace as follows is used for the sintering: a burner-type sintering furnace, a rotary sintering furnace, or an electric furnace.

<Step 3 (Pulverization Step)>

The presintered ferrite produced in step 2 is pulverized using a pulverizer to obtain a finely pulverized presintered ferrite product. There are no particular limitations on the pulverizer as long as the desired particle diameter and particle diameter distribution can be obtained, and this pulverizer can be exemplified by the following: crushers, hammer mills, ball mills, bead mills, planetary mills, and Giotto mills.

The 50% particle diameter (D50) on a volume basis of this finely pulverized presintered ferrite product is preferably from at least 0.5 μm to not more than 5.0 μm. Doing this enables facile control of the pore diameter corresponding to the maximum logarithmic differential pore volume and of P1 (the maximum value of the logarithmic differential pore volume in the range from at least 0.80 μm to not more than 1.50 μm).

In addition, the 90% particle diameter (D90) on a volume basis of the finely pulverized presintered ferrite product is preferably made from at least 3.0 μm to not more than 10.0 μm. P2/P1 can be controlled by doing this.

The finely pulverized presintered ferrite product is preferably brought to the particle diameters given above, for example, by controlling the material of the balls or beads used in a ball mill or bead mill and by controlling the operating time. In specific terms, in order to reduce the particle diameter of the finely pulverized presintered ferrite product, balls with a heavy specific gravity can be used and the pulverizing time can be lengthened. In order to broaden the particle diameter distribution of the finely pulverized presintered ferrite product, this can be achieved by using balls with a heavy specific gravity and shortening the pulverizing time. In addition, a finely pulverized presintered ferrite product with a broad distribution can also be obtained by mixing a plurality of finely pulverized presintered ferrite products that have different particle diameters. The material of the balls or beads is not particularly limited as long as the desired particle diameter/distribution can be obtained, and can be exemplified by the following: glasses such as soda glass (specific gravity=2.5 g/cm$^3$), sodaless glass (specific gravity=2.6 g/cm$^3$), and high specific gravity glass (specific gravity=2.7 g/cm$^3$), as well as quartz (specific gravity=2.2 g/cm$^3$), titania (specific gravity=3.9 g/cm$^3$), silicon nitride (specific gravity=3.2 g/cm$^3$), alumina (specific gravity=3.6 g/cm$^3$), zirconia (specific gravity=6.0 g/cm$^3$), steel (specific gravity=7.9 g/cm$^3$), and stainless steel (specific gravity=8.0 g/cm$^3$). Among the preceding, alumina, zirconia, and stainless steel are preferred for their excellent abrasion resistance.

The particle diameter of the balls or beads is also not particularly limited as long as the desired particle diameter and particle diameter distribution are obtained. In the case of balls, for example, balls with a diameter of from at least 5 mm to not more than 60 mm are favorably used. In the case of beads, beads with a diameter of from at least 0.03 mm to less than 5 mm are favorably used.

In addition, in comparison to dry methods, the use of wet methods in a ball mill or bead mill provides a higher pulverization efficiency without upward flight of the pulverization product in the mill, and for this reason wet methods are more preferred than dry methods.

<Step 4 (Granulating Step)>

Water, a binder, and optionally a pore modifier and/or a dispersing agent are added to the obtained finely pulverized presintered ferrite product. For example, polyvinyl alcohol may be used as the binder. Known pore modifiers and known dispersing agents can be used here.

When pulverization has been carried out in step 3 using a wet method, addition of the binder and optional pore modifier and so forth is preferably performed also taking into consideration the water present in the slurry of the finely pulverized presintered ferrite product (ferrite slurry). In order to control the porosity, granulation is preferably performed using a slurry solids concentration of from at least 50 mass % to not more than 80 mass %.

The obtained ferrite slurry is dried/granulated using an atomizing dryer in a heated atmosphere having a temperature of from at least 100° C. to not more than 200° C.

The use of a spray dryer for the atomizing dryer is favorable for facilitating control of the particle diameter of the porous ferrite core to the desired value. The particle diameter of the porous ferrite core can be controlled through a suitable selection of the disk rpm and the spray flow rate at the spray dryer.

<Step 5 (Main Sintering Step)>

The obtained granulate is then preferably sintered for from at least 1 hour to not more than 24 hours at a temperature from at least 800° C. to not more than 1400° C. From at least 1000° C. to not more than 1200° C. is more preferred. The sintering temperature and sintering time are preferably controlled within these ranges in order to bring P1 to from at least 0.07 mL/g to not more than 0.35 mL/g.

Raising the sintering temperature and lengthening the sintering time cause sintering of the porous ferrite core to advance and as a result cause the pore diameter to become smaller and also cause a reduction in the number of pores. In addition, the resistance of the porous ferrite core can be controlled into the preferred range by controlling the sintering atmosphere. The resistivity of the porous ferrite core at 100 V/cm can be brought into the desired range by having the oxygen concentration be preferably not more than 0.1 volume % and more preferably not more than 0.01 volume % and by also setting up a reducing atmosphere (presence of hydrogen).

<Step 6 (Classification Step)>

After the particles sintered as described above have been ground, as necessary the coarse particles and/or fines may be removed by classification or sieving on a sieve.

The porous ferrite core more preferably has a 50% particle diameter (D50) on a volume basis of from at least 18.0 μm to not more than 68.0 μm in order to maintain the flowability of the carrier and stabilize its charge-providing performance and thus prevent density variations.

Depending on the number and size of the pores, the porous ferrite core obtained in the described manner may be prone to exhibit a reduced physical strength and may be susceptible to fracture. As a consequence, the physical strength of the magnetic carrier is raised by filling a resin into the pores of the porous ferrite core to provide a resin-containing ferrite particle, followed by, for example, additionally coating with a resin.

There are no particular limitations on the method for filling resin into the pores of the porous ferrite core, and this method can be exemplified by immersion methods, spray methods, brushing methods, and methods in which a resin solution of resin mixed with solvent is impregnated into the porous ferrite core by a coating method such as a fluidized bed and subsequently evaporating the solvent.

This solvent should be able to dissolve the resin. For the case of an organic solvent-soluble resin, the organic solvent can be exemplified by toluene, xylene, butyl cellosolve acetate, methyl ethyl ketone, methyl isobutyl ketone, and methanol. Water may be used as the solvent in the case of water-soluble resins and emulsion-type resins.

The amount of the resin solid fraction in this resin solution is preferably from at least 1 mass % to not more than 50 mass % and more preferably is from at least 1 mass % to not more than 30 mass %. When a resin solution is used that contains more than 50 mass % resin, the resulting high viscosity impedes the uniform permeation of the resin solution into the pores of the porous ferrite core. In addition, at less than 1 mass %, little resin is present and the attachment force by the resin to the porous ferrite core may be reduced.

There are no particular limitations on the resin that may be filled into the pores of the porous ferrite core, and, while a thermoplastic resin or a thermosetting resin may be used, a resin that exhibits a high affinity for the porous ferrite core is preferred. When a resin having a high affinity is used, the surface of the porous ferrite core is then also easily coated by the resin at the same time as the filling of the resin into the pores of the porous ferrite core.

Silicone resins and modified silicone resins are specifically preferred for the fill resin because they have a high affinity for the porous ferrite core. A heretofore known silicone resin can be used as this silicone resin.

The following are examples of commercially available products: straight silicone resins such as KR271, KR255, and KR152 from Shin-Etsu Chemical Co., Ltd., and SR2400, SR2405, SR2410, and SR2411 from Dow Corning Toray Co., Ltd., as well as modified silicone resins such as KR206 (alkyd modified), KR5208 (acrylic modified), ES1001N (epoxy modified), and KR305 (urethane modified) from Shin-Etsu Chemical Co., Ltd., and SR2115 (epoxy modified) and SR2110 (alkyd modified) from Dow Corning Toray Co., Ltd.

The magnetic carrier of the present invention has a resin-containing ferrite particle that contains the porous ferrite core and the resin in the pores of the porous ferrite core.

Taking into consideration, for example, the release behavior, anti-contamination performance, charge-providing performance, and adjustment of the resistance, the magnetic carrier of the present invention can also be favorably exemplified by an embodiment in which the surface is additionally coated with a resin after a resin has been filled into the pores of the porous ferrite core particle. In this case, the fill resin and the resin coating material used for coating may be the same or may differ from one another and may be a thermoplastic resin or a thermosetting resin. An acrylic resin, which exhibits a better durability and enables long-term use under high-stress conditions of use, for example, in a high-speed copier, is preferably used as the aforementioned resin in the present invention.

A single resin may be used for the resin under consideration or a mixture of a plurality of resins may be used. A thermoplastic resin may also be used by admixing a curing agent and so forth into the thermoplastic resin and curing. In addition, the use is preferred of a resin that exhibits a better release behavior.

The aforementioned coating material, on the other hand, may contain electroconductive particles and/or particles that have a charge-control function. The electroconductive particles can be exemplified by carbon black, magnetite, graphite, zinc oxide, and tin oxide. The particles having a charge-control function can be exemplified by particles of an organometallic complex, particles of an organometallic salt, particles of a chelate compound, particles of a monoazo-metal complex, particles of an acetylacetone-metal complex, particles of a hydroxycarboxylic acid-metal complex, particles of a polycarboxylic acid-metal complex, particles of a polyol-metal complex, particles of a polymethyl methacrylate resin, particles of a polystyrene resin, particles of a melamine resin, particles of a phenolic resin, particles of a nylon resin, silica particles, titanium oxide particles, and alumina particles.

There are no particular limitations on the method used to carry out the additional coating of the surface with resin after a resin has been filled into the pores of the porous ferrite core particle, and, for example, immersion methods, spray methods, brushing methods, and methods in which coating is performed by a coating method such as a fluidized bed may be used.

The magnetic carrier of the present invention preferably has a 50% particle diameter (D50) on a volume basis of from at least 20.0 μm to not more than 60.0 μm. Compliance with this particular range is preferred from the standpoint of the stability of the ability to triboelectrically charge the toner.

The 50% particle diameter (D50) of the magnetic carrier can be adjusted into the indicated range using air classification or classification with a sieve.

The toner used by the present invention is described in the following.

There are no particular limitations on the toner in the present invention and known toners can be used; however, the attachment force between the magnetic carrier and the toner can be favorably controlled when the average circularity of the toner having a circle-equivalent diameter of from at least 1.98 μm to less than 39.69 μm is from at least 0.940 to not more than 1.000 in an analysis—using 800 intervals in the circularity range from at least 0.200 to not more than 1.000—of the circularity measured using a flow-type particle image analyzer having an image processing resolution of 512×512 pixels (0.37 μm×0.37 μm per pixel). This is preferred because it results in the maintenance of a high developing performance and in the generation of a stable image density even under high-stress conditions of use, for example, in a high-speed copier.

The circularity of the toner can be controlled through the toner production method, vide infra, and by subjecting the toner particle to a surface modification treatment.

The binder resin in the toner is not particularly limited, and the resins known for use in toners can be used. However, the following are preferred in order for the storability of the toner to coexist in balance with its low-temperature fixability: a peak molecular weight (Mp) in the molecular weight distribution measured by gel permeation chromatography (GPC) of from at least 2000 to not more than 50,000, a number-average molecular weight (Mn) of from at least 1500 to not more than 30,000, and a weight-average molecular weight (Mw) of from at least 2000 to not more than 1,000,000, and a glass transition temperature (Tg) of from at least 40° C. to not more than 80° C.

A wax known for use in toners may also be used for the wax, and the use of from at least 0.5 mass parts to not more than 20 mass parts per 100 mass parts of the binder resin is preferred. In addition, a peak temperature for the maximum endothermic peak of the wax of from at least 45° C. to not more than 140° C. is preferred because this makes it possible for the storability of the toner to coexist in balance with the hot offset resistance.

Advantageous examples of the wax are as follows: hydrocarbon waxes such as low molecular weight polyethylenes, low molecular weight polypropylenes, alkylene copolymers, microcrystalline waxes, paraffin waxes, and Fischer-Tropsch waxes; the oxides of hydrocarbon waxes, such as oxidized polyethylene waxes, and their block copolymers; waxes in which the main component is a fatty acid ester, such as carnauba wax, a behenyl behenate ester wax, and a montanic acid ester wax; and the product of the partial or complete deacidification of a fatty acid ester, such as deacidified carnauba wax.

A colorant known for use in toners may also be used for the colorant. The amount of colorant use, expressed per 100 mass parts of the binder resin, is preferably from at least 0.1 mass parts to not more than 30 mass parts and more preferably from at least 0.5 mass parts to not more than 20 mass parts.

The toner may also optionally contain a charge-control agent. The charge-control agent used in the toner can be a known charge-control agent, but an aromatic carboxylic acid-metal compound that is colorless, can provide a fast charging speed for the toner, and can stably maintain a prescribed amount of charge is particularly preferred. Negative charge-control agents can be exemplified by metal salicylate compounds, metal naphthoate compounds, metal dicarboxylate compounds, polymeric compounds having a sulfonic acid or carboxylic acid in side chain position, polymeric compounds having a sulfonate salt or a sulfonate ester in side chain position, polymeric compounds having a carboxylate salt or a carboxylate ester in side chain position, boron compounds, urea compounds, silicon compounds, and calixarene. Positive charge-control agents can be exemplified by quaternary ammonium salts, polymeric compounds having such a quaternary ammonium salt in side chain position, guanidine compounds, and imidazole compounds. The charge-control agent may be internally added or externally added to the toner particle. The amount of charge-control agent addition is preferably from at least 0.2 mass parts to not more than 10 mass parts per 100 mass parts of the binder resin.

An external additive is preferably added to the toner in order to improve the flowability. This external additive is preferably an inorganic fine powder such as silica, titanium oxide, or aluminum oxide. This inorganic fine powder is preferably hydrophobed with a hydrophobic agent such as a silane compound or a silicone oil. The external additive is preferably used at from at least 0.1 mass parts to not more than 8.0 mass parts per 100 mass parts of the toner particles.

The toner particles and the external additive can be mixed using a known mixing device, such as a Henschel mixer.

The method of producing the toner particles can be exemplified by the following: pulverization methods, in which the resin binder and colorant are melt kneaded and the kneaded product is cooled and then pulverized and classified; suspension granulation methods, in which suspension granulation is performed by introducing a solution of the binder resin and colorant dissolved or dispersed in a solvent into an aqueous medium and the toner particles are then obtained by removing the solvent; suspension polymerization methods, in which a monomer composition, prepared by uniformly dissolving or dispersing the colorant and so forth in monomer, is dispersed in a continuous layer (for example, an aqueous phase) that contains a dispersion stabilizer and the toner particles are then produced by carrying out a polymerization reaction; dispersion polymerization methods, in which the toner particles are directly produced using an aqueous organic solvent in which the monomer is soluble but the obtained polymer is insoluble; emulsion polymerization methods, in which the toner particles are produced by polymerization directly in the presence of a water-soluble polar polymerization initiator; and emulsion aggregation methods, in which the toner particles are obtained proceeding through a step of forming an aggregate of finely divided particles by aggregating at least polymer fine particles and colorant fine particles and an aging step of inducing melt adhesion among the finely divided particles in the aggregate of finely divided particles.

The toner particle production sequence using a pulverization method is described in the following, but there is no limitation to this. In a raw material mixing step, the materials that will constitute the toner particles, for example, the binder resin, colorant, and wax, the charge-control agent, and other components, are metered out in prescribed amounts, blended, and mixed. The mixer can be exemplified by double-cone mixers, V-mixers, drum mixers, super mixers, Henschel mixers, Nauta mixers, and the Mechano Hybrid (Mitsui Mining Co., Ltd.).

The resulting raw material mixture is then melt kneaded in order to disperse the colorant and so forth in the binder resin. A batch kneader, e.g., a pressure kneader or a Banbury mixer, or a continuous kneader can be used in this melt kneading step, and a singe-screw or twin-screw extruder is typically used because they offer the advantage of enabling continuous production. Examples here are the KTK twin-screw extruder (Kobe Steel, Ltd.), TEM twin-screw extruder (Toshiba Machine Co., Ltd.), PCM kneader (Ikegai Corp.), Twin Screw Extruder (KCK), Co-Kneader (Buss), and Kneadex (Mitsui Mining Co., Ltd.).

The colored resin composition obtained by melt kneading may additionally be rolled out using, for example, a two-roll mill and cooled in a cooling step, for example, with water.

The cooled resin composition is then pulverized to the desired particle diameter in a pulverization step. In the pulverization step, a coarse pulverization is performed using a grinder such as a crusher, hammer mill, or feather mill, followed by a fine pulverization using a pulverizer such as a Krypton System (Kawasaki Heavy Industries, Ltd.), Super Rotor (Nisshin Engineering Inc.), or Turbo Mill (Turbo Kogyo Co., Ltd.) or using an air jet system. The toner particles are then obtained as necessary by carrying out classification using a sieving apparatus or a classifier, e.g., an inertial classification system such as the Elbow Jet (Nittetsu Mining Co., Ltd.) or a centrifugal classification system such as the Turboplex (Hosokawa Micron Corporation), TSP Separator (Hosokawa Micron Corporation), or Faculty (Hosokawa Micron Corporation). After pulverization, the toner particles may as necessary also be subjected to a surface modification treatment, such as a spheronizing treatment, using a Hybridization System (Nara Machinery Co., Ltd.), Mechanofusion System (Hosokawa Micron Corporation), Faculty (Hosokawa Micron Corporation), or Meteo Rainbow MR Type (Nippon Pneumatic Mfg. Co., Ltd.).

For example, a surface modification apparatus as shown in FIG. 1 may be used to carry out surface modification of the toner particles. Using an autofeeder 2, the toner particles 1 are passed through a feed nozzle 3 and are fed to the surface modification apparatus interior 4. The air in the surface modification apparatus interior 4 is suctioned through the action of a blower 9 and the toner particles 1 introduced from the feed nozzle 3 are dispersed in the interior of the apparatus. The toner particles 1 dispersed in the interior of the apparatus undergo surface modification through the instantaneous application of heat by a hot air current that is introduced from a hot air current introduction port 5. The hot air current is produced by a heater in the present invention, but there is no particular limitation on the apparatus as long as it can produce a hot air current sufficient to effect surface modification of the toner particles. The surface-modified toner particles 7 are instantaneously cooled by a cold air current introduced from a cold air current introduction port 6. Liquid nitrogen is used for the cold air current in the present invention, but there is no particular limitation on the means as long as the surface-modified toner particles 7 can be instantaneously cooled. The surface-modified toner particles 7 are suctioned off by the blower 9 and are collected by a cyclone 8.

The two-component developer of the present invention contains at least the magnetic carrier of the present invention and a toner.

The two-component developer of the present invention can be used as a developer that is used for development by being carried on a developer bearing member housed in a developing device. When used as a developer, the mixing ratio between the magnetic carrier and toner is preferably from at least 2 mass parts to not more than 35 mass parts of toner and more preferably is from at least 4 mass parts to not more than 25 mass parts of toner, per 100 mass parts of the magnetic carrier. Compliance with this range makes it possible to achieve a high image density and reduce toner scattering.

The two-component developer of the present invention containing the magnetic carrier and toner can also be used as the replenishing developer that is used in a two-component developing method in which magnetic carrier replenished to the developing device and becoming present in excess at least within the developing device is discharged from the developing device.

In the case of use as a replenishing developer, the mixing ratio between the magnetic carrier and toner is, viewed from the standpoint of increasing the durability of the developer, preferably from at least 2 mass parts to not more than 50 mass parts of toner per 1 mass parts of the magnetic carrier.

The methods used to measure the properties of the magnetic carrier and toner are described in the following.

<Measurement of the Resistivity of the Porous Ferrite Core at a Field Strength of 100 V/cm>

The resistivity of the porous ferrite core at a field strength of 100 V/cm is measured using the measurement apparatus that is schematically illustrated in FIG. 2.

Figure 2A:
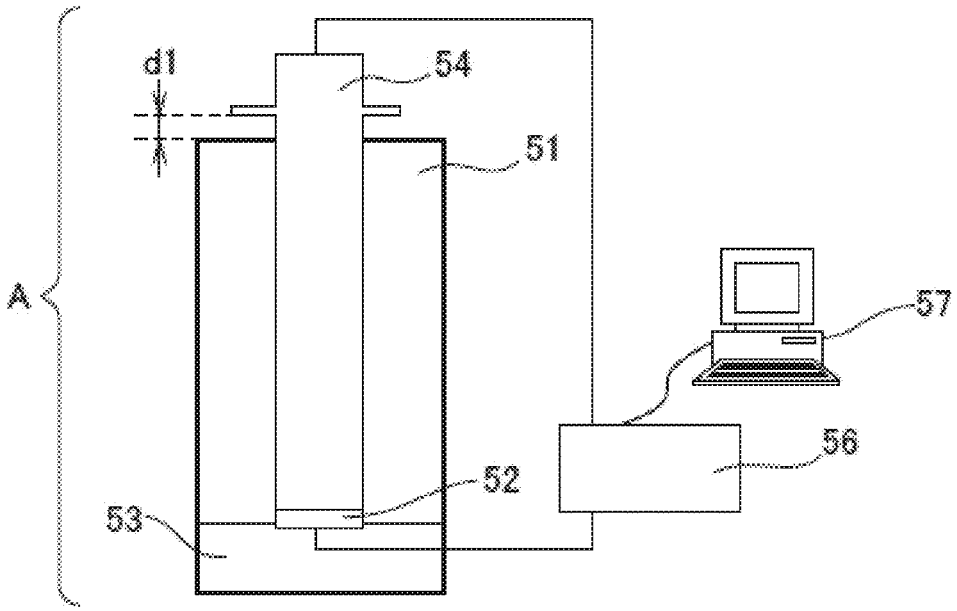
FIG. 2A and FIG. 2B are schematic diagrams of an instrument for measuring the resistivity of a porous ferrite core particle used by the present invention.
Figure 2B:
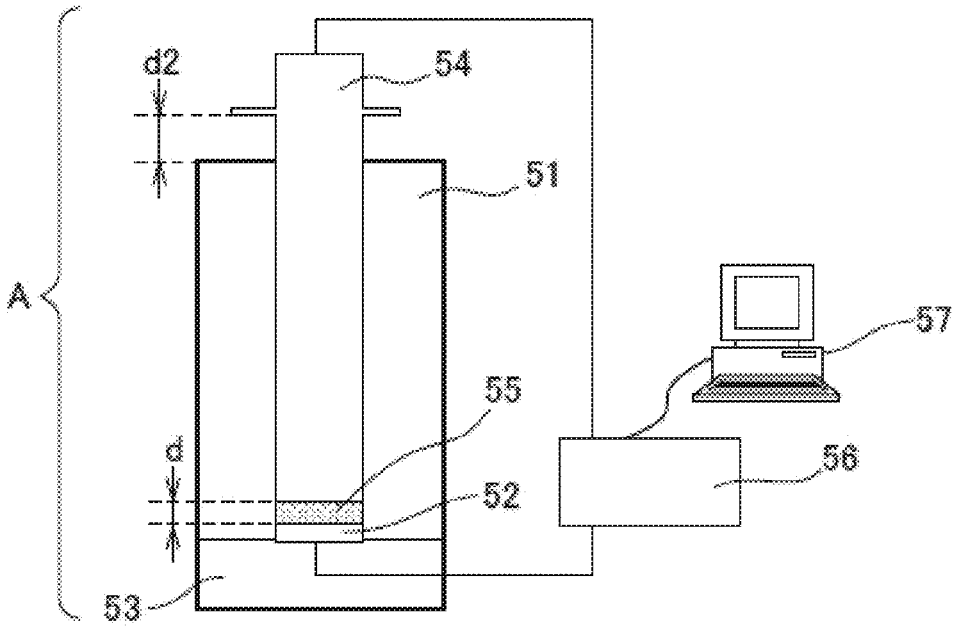

A resistance measurement cell A is composed of a cylindrical PTFE resin container 51 having an opening with a cross-sectional area of 2.4 $cm^2$, a lower electrode (stainless steel) 52, a support base (PTFE in) 53, and an upper electrode (stainless steel) 54. The cylindrical PTFE resin container 51 is mounted on the support base 53; the sample (porous ferrite core) 55 is filled to a thickness of approximately 1 mm; the upper electrode 54 is mounted on the filled sample 55; and the thickness of the sample is measured. The sample thickness d is then calculated using the following equation where d1 is the distance in the absence of the sample as shown in FIG. 2A and d2 is the distance when the sample has been filled to a thickness of approximately 1 mm as shown in FIG. 2B.

$$d=d2-d1$$

The mass of the sample may be varied at this time as appropriate so as to provide a sample thickness of from at least 0.95 mm to 1.04 mm.

The resistivity of the porous ferrite core can be determined by applying a direct-current voltage between the electrodes and measuring the current that flows when this is done. An electrometer 56 (Keithley 6517A from Keithley Instruments Inc.) and a process control computer 57 are used for the measurement.

Control software (LabVIEW from National Instruments Corporation) and a control system from National Instruments Corporation are used for the process control computer.

The following are input for the measurement conditions: a contact area between the sample and electrode S=2.4 $cm^2$ and the actually measured value of d providing a sample thickness of from at least 0.95 mm to not more than 1.04 mm. In addition, the load of the upper electrode is set at 270 g and the maximum applied voltage is set at 1000 V.

With regard to the voltage application conditions, screening is performed by applying the following voltages for 1 second each using an IEEE-488 interface for control between the process control computer and the electrometer, using auto range function of the electrometer: 1 V ($2^0$ V), 2 V ($2^1$ V), 4 V ($2^2$ V), 8 V ($2^3$ V), 16 V ($2^4$ V), 32 V ($2^5$ V), 64 V ($2^6$ V), 128 V ($2^7$ V), 256 V ($2^8$ V), 512 V ($2^9$ V), and 1000 V. During this process, the electrometer evaluates whether application is possible up to the maximum of 1000 V (for example, a field strength of 10,000 V/cm when the sample thickness is 1.00 mm), and "VOLTAGE SOURCE OPERATE" flashes when an excess current flows. In this case, the instrument automatically determines the maximum value for the applied voltage by lowering the applied voltage and carrying out additional screening for the applicable voltage. The main measurement is then carried out. The individual voltage steps are obtained by dividing this maximum voltage value by 5, and the resistance value is measured from the current value after holding for 30 seconds. Taking, for example, the case in which the maximum applied voltage is 1000 V, the voltage is applied in an ascending and then descending sequence using a 200 V interval, which is ⅕ of the maximum applied voltage, of 200 V (first step), 400 V (second step), 600 V (third step), 800 V (fourth step), 1000 V (fifth step), 1000 V (sixth step), 800 V (seventh step), 600 V (eighth step), 400 V (ninth step), and 200 V (tenth step), and the resistance value is measured at each step from the current value after holding for 30 seconds.

An example of the measurement on a porous ferrite core will now be described. The screening was performed first in the measurement, and, when voltages of 1 V ($2^0$ V), 2 V ($2^1$ V), 4 V ($2^2$ V), 8 V ($2^3$ V), 16 V ($2^4$ V), 32 V ($2^5$ V), 64 V ($2^6$ V), and 128 V ($2^7$ V) were applied for 1 second each, the "VOLTAGE SOURCE OPERATE" display was on up to and including 64 V and the "VOLTAGE SOURCE OPERATE" display flashed at 128 V. The maximum applicable voltage was approached with flashing at 90.5 V ($2^{6.5}$ V), on at 68.6 V ($2^{6.1}$ V), and flashing at 73.5 V ($2^{6.2}$ V), and a maximum applied voltage of 69.8 V was determined as a result. Voltages are then applied in the following sequence: 14.0 V (first step), which is the value that is one-fifth of 69.8 V; 27.9 V (second step), which is the value that is two-fifths; 41.9 V (third step), which is the value that is three-fifths; 55.8 V (fourth step), which is the value that is four-fifths; 69.8 V (fifth step), which is the value that is five-fifths; 69.8 V (sixth step); 55.8 V (seventh step); 41.9 V (eighth step); 27.9 V (ninth step); and 14.0 V (tenth step). The current values obtained here are processed by the computer and the resistivity and field strength are determined using a sample thickness of 0.97 mm and the electrode area and are plotted on a graph. In this case, the five points for the voltage descending from the maximum applied voltage are plotted. When in the measurements at the individual steps the "VOLTAGE SOURCE OPERATE" flashes and excess current is flowing, the resistance value is indicated by 0 for purposes of the measurement.

$$\text{resistivity } (\Omega\cdot\text{cm}) = (\text{applied voltage } (V)/\text{measured current } (A)) \times S\ (\text{cm}^2)/d\ (\text{cm})$$

$$\text{field strength } (V/\text{cm}) = \text{applied voltage } (V)/d\ (\text{cm})$$

For the resistivity of the porous ferrite core at a field strength of 100 V/cm, the resistivity is read from the graph at a field strength of 100 V/cm on the graph. The resistivity at 100 V/cm is favorably read off in this measurement of the porous ferrite core.

<Measurement of the Pore Volume, Pore Diameter, and Pore Diameter Distribution of the Pores of the Porous Ferrite Core>

The pore volume, pore diameter, and pore diameter distribution of the pores of the porous ferrite core are measured by the mercury intrusion method.

The measurement principle is as follows. In this measurement, the amount of mercury penetrating into the pores is measured while varying the pressure applied to the mercury. The condition at which mercury can penetrate within a pore is expressed by $PD=-4\sigma \cos\theta$ from the force equilibrium, for a pressure P and a pore diameter D where $\theta$ and $\sigma$ are, respectively, the contact angle and surface tension of the mercury. Assuming constant values for the contact angle and surface tension, the pressure P is then inversely proportional to the pore diameter D into which the mercury can filtrate at P. As a consequence, the pore diameter distribution was acquired by building a P-V curve by measuring, at different pressures, the pressure P and the amount of fluid V intruded at P and converting the P on the horizontal axis of this P-V curve directly to the pore diameter using the aforementioned relationship, and the logarithmic differential pore volume was calculated in the pore diameter range from at least 0.10 μm to not more than 3.00 μm.

The measurement can be carried out using, for example, a PoreMaster series/PoreMaster-GT series fully automated multifunctional mercury porosimeter from Yuasa Ionics Co., Ltd. or an Autopore IV 9500 series automated porosimeter from Shimadzu Corporation, for the measurement instrument. Specifically, the measurement was run using the following conditions and procedure with an Autopore IV 9520 from Shimadzu Corporation. Measurement conditions: "measurement environment: 20° C.", "measurement cell: sample volume 5 $cm^3$, intrusion volume 1.1 $cm^3$, application for powder", "measurement range: at least 2.0 psia (13.8 kPa), not more than 59989.6 psia (413.7 MPa)", "measurement step: 80 steps (the steps are set up so as to provide equal intervals when the pore diameter is converted to the logarithm)", "intrusion volume: adjust to provide from at least 25% to not more than 70%", "low pressure parameters; exhaust pressure: 50 μmHg, exhaust time: 5.0 min, mercury injection pressure: 2.0 psia (13.8 kPa), equilibration time: 5 secs", "high pressure parameter; equilibration time: 5 secs", "mercury parameters: advancing contact angle: 130.0 degrees, receding contact angle: 130.0 degrees, surface tension: 485.0 mN/m (485.0 dynes/cm), density of mercury: 13.5335 g/mL".

(Measurement Procedure)

(1) Approximately 1.0 g of the porous ferrite core is weighed out and introduced into a measurement cell. The weighed out value is input.

(2) Measurement is carried out in the low pressure region at from at least 2.0 psia (13.8 kPa) to not more than 45.8 psia (315.6 kPa).

(3) Measurement is carried out in the high pressure region at from at least 45.9 psia (316.3 kPa) to not more than 59989.6 psia (413.6 MPa).

(4) The pore diameter distribution and average pore diameter are calculated from the mercury injection pressure and the amount of mercury injection. This average pore diameter is the value calculated by analysis with the provided software, and is the value of the median pore diameter (volume basis) assigned to the pore diameter range of from at least 0.10 μm to not more than 3.00 μm.

Figure 3A:
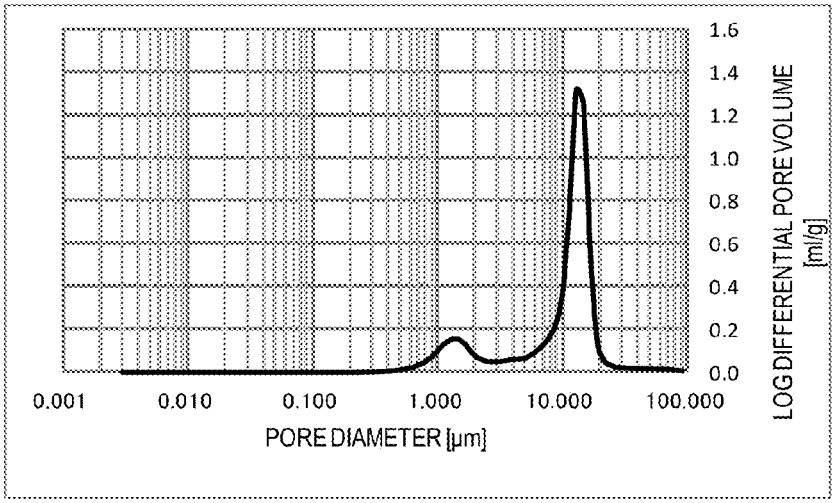
FIG. 3A is an example of the results over the entire measurement range for the pore diameter distribution of the pores measured by a mercury intrusion method on a porous ferrite core.
Figure 3B:
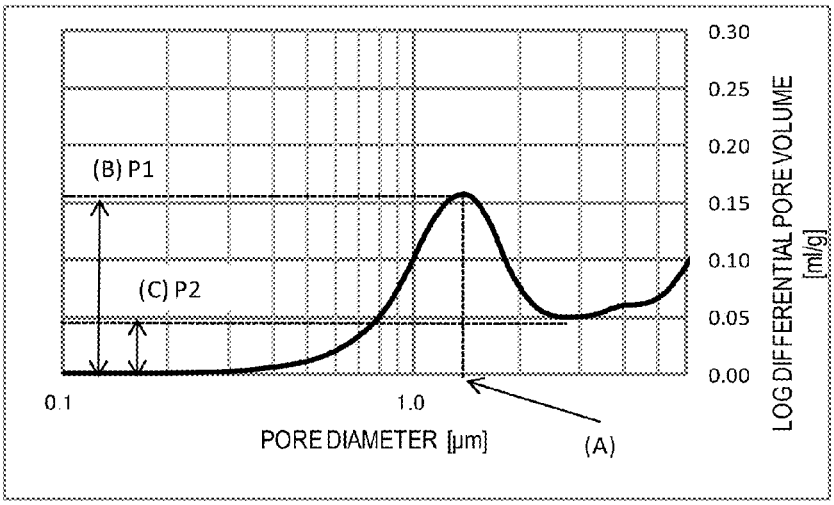
FIG. 3B is an example of the results in the pore diameter range from at least 0.10 μm to not more than 6.00 μm in the pore diameter distribution of the pores measured by a mercury intrusion method on a porous ferrite core.

(2), (3), and (4) were performed automatically using the software provided with the instrument. An example of the pore diameter distribution measured as described in the preceding is shown in FIG. 3. FIG. 3A is a diagram of the entire measurement range for the porous ferrite core particle, while an enlarged area therefrom is shown in FIG. 3B. (A) refers to the pore diameter corresponding to the maximum logarithmic differential pore volume in the pore diameter range from at least 0.10 μm to not more than 3.00 μm. (B) refers to P1, which is the maximum value of the logarithmic differential pore volume in a pore diameter range from at least 0.80 μm to not more than 1.50 μm. (C) refers to P2, which is the minimum value of the logarithmic differential pore volume in a pore diameter range from at least 2.00 μm to not more than 3.00 μm.

Figure 3C:
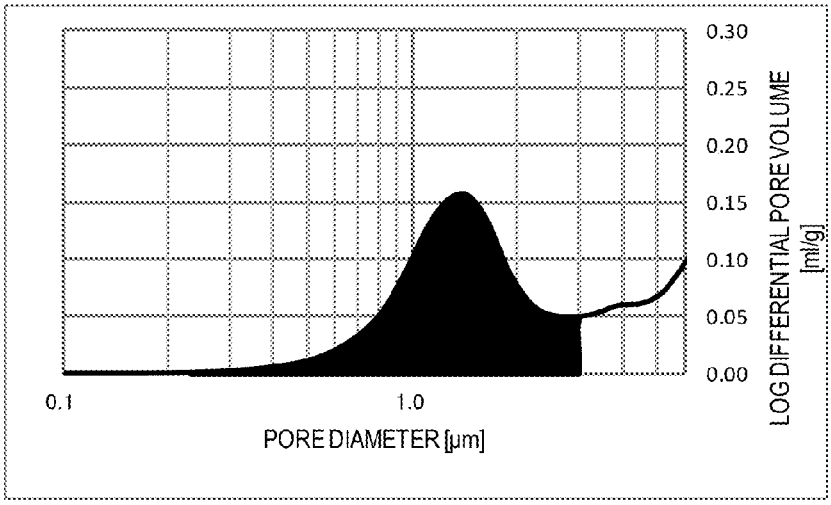
FIG. 3C is an example of the calculation, using the provided software, of the pore volume (solid region in the figure) provided by integrating the logarithmic differential pore volume in the pore diameter range from at least 0.10 μm to not more than 3.00 μm measured by mercury intrusion on a porous ferrite core.

Using the provided software, the pore volume provided by integrating the logarithmic differential pore volume in the pore diameter range of from at least 0.10 μm to not more than 3.00 μm (the solid-filled area in the figure) was calculated from FIG. 3C.

<Method for Measuring the 50% Particle Diameter (D50) on a Volume Basis, of the Magnetic Carrier and Porous Ferrite Core>

The particle diameter distribution was measured using a "Microtrac MT3300EX" (Nikkiso Co., Ltd.) laser diffraction/scattering particle size distribution analyzer.

The measurement of the 50% particle diameter (D50) on a volume basis was carried out on the magnetic carrier and porous ferrite core with a "Turbotrac One-Shot Dry Sample Conditioner" (Nikkiso Co., Ltd.) dry measurement sample feeder installed. The feed conditions with the Turbotrac were as follows: a dust collector was used as the vacuum source; the flow rate was approximately 33 L/sec; and the pressure was approximately 17 kPa. Control was carried out automatically with the software. The 50% particle diameter (D50) that is the cumulative value on a volume basis is determined for the particle diameter. Control and analysis are performed using the provided software (version 10.3.3-202D). The measurement conditions are set as follows: SetZero time=10 seconds, measurement time=10 seconds, number of measurements=1, particle refractive index=1.81, particle shape=nonspherical, measurement upper limit=1408 μm, measurement lower limit=0.243 μm. The measurement is carried out in a normal temperature, normal humidity (23° C., 50% RH) environment.

<Method for Measuring the Average Circularity of the Toner>

The average circularity of the toner is measured with an "FPIA-3000" flow particle image analyzer (Sysmex Corporation) using the measurement and analysis conditions used during the calibration process.

The specific measurement method is as follows. Approximately 20 mL ion-exchanged water—from which, e.g., solid impurities and so forth, have already been removed—is first introduced into a glass container. To this is added about 0.2 mL of a dilution prepared by the approximately three-fold (mass) dilution with ion-exchanged water of the dispersing agent "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.). Approximately 0.02 g of the measurement sample is also added and a dispersion treatment is carried out for 2 minutes using an ultrasound disperser to provide a dispersion for measurement. Cooling is carried out as appropriate during this treatment so as to provide a dispersion temperature of at least 10° C. and no more than 40° C. A benchtop ultrasound cleaner/disperser having an oscillation frequency of 50 kHz and an electrical output of 150 W (for example, a VS-150 from Velvo-Clear Co., Ltd.) is used as the ultrasound disperser. A prescribed amount of ion-exchanged water is introduced into the water tank and approximately 2 mL Contaminon N is added to the water tank.

The above-described flow particle image analyzer fitted with a standard objective lens (10×) was used for the measurement, and Particle Sheath "PSE-900A" (Sysmex Corporation) was used for the sheath solution. The dispersion prepared according to the above-described procedure is introduced into the flow particle image analyzer and 3000 toner particles are measured according to total count mode in HPF measurement mode. By setting the binarization threshold value during particle analysis to 85% and specifying the analyzed particle diameter, the number % (%) and average circularity of particles in this range can be calculated. For the average circularity of the toner, the average circularity of the toner was determined for a circle-equivalent diameter of from at least 1.98 μm to not more than 39.69 μm.

For this measurement, automatic focal point adjustment is performed prior to the start of the measurement using reference latex particles (for example, a dilution with ion-exchanged water of "RESEARCH AND TEST PARTICLES Latex Microsphere Suspensions 5200A" from Duke Scientific). After this, focal point adjustment is preferably performed every 2 hours after the start of measurement.

The examples in this application used a flow particle image analyzer that had been calibrated by the Sysmex Corporation and that had been issued a calibration certificate by the Sysmex Corporation. The measurements were carried out using the measurement and analysis conditions used during the calibration certification, with the exception of the limitation of the analyzed particle diameter to a circle-equivalent diameter of from at least 1.98 μm to less than 39.69 μm.

<Measurement of the Weight-Average Particle Diameter (D4) of the Toner>

The weight-average particle diameter (D4) of the toner was calculated using a "Coulter Counter Multisizer 3" (registered trademark of Beckman Coulter, Inc.), which is a precision particle diameter distribution analyzer that uses the pore electrical resistance principle and is equipped with a 100 μm aperture tube, and using the "Beckman Coulter Multisizer 3 Version 3.51" software (from Beckman Coulter, Inc.), for setting the measurement conditions and analyzing the measurement data, provided with the instrument, to perform measurements at 25,000 channels for the number of effective measurement channels and to carry out analysis of the measurement data.

A solution of special-grade sodium chloride dissolved in ion-exchanged water and brought to a concentration of approximately 1 mass %, for example, "ISOTON II" (Beckman Coulter, Inc.), can be used for the aqueous electrolyte solution used for the measurement.

The dedicated software is set as follows prior to running the measurement and analysis. On the "Change Standard Operating Method (SOM)" screen of the dedicated software, the total count number for the control mode is set to 50000 particles, the number of measurements is set to 1, and the value obtained using "10.0 μm standard particles" (from Beckman Coulter, Inc.) is set for the Kd value. The threshold value and noise level are automatically set by pressing the threshold value/noise level measurement button. The current is set to 1600 μA, the gain is set to 2, the electrolyte solution is set to ISOTON II, and flush aperture tube after measurement is checked.

On the "pulse-to-particle diameter conversion setting" screen of the dedicated software, the bin interval is set to logarithmic particle diameter, the particle diameter bin is set to 256 particle diameter bins, and the particle diameter range is set to from at least 2 μm to not more than 60 μm.

The specific measurement method is as follows.

(1) Approximately 200 mL of the above-described aqueous electrolyte solution is introduced into the glass 250-mL roundbottom beaker provided for use with the Multisizer 3 and this is then set into the sample stand and counterclockwise stirring is performed with a stirring rod at 24 rotations per second. Dirt and bubbles in the aperture tube are removed using the "aperture flush" function of the analytic software.

(2) Approximately 30 mL of the above-described aqueous electrolyte solution is introduced into a glass 100-mL flatbottom beaker. To this is added the following as a dispersing agent: approximately 0.3 mL of a dilution prepared by diluting "Contaminon N" (a 10 mass % aqueous solution of a neutral pH 7 detergent for cleaning precision measurement instrumentation, comprising a nonionic surfactant, an anionic surfactant, and an organic builder, from Wako Pure Chemical Industries, Ltd.) three-fold on a mass basis with ion-exchanged water.

(3) A prescribed amount of ion-exchanged water is introduced into the water tank of an "Ultrasonic Dispersion System Tetora 150" ultrasound disperser (Nikkaki Bios Co., Ltd.), which has an output of 120 W and is equipped with two oscillators oscillating at 50 kHz and configured with a phase shift of 180°, and approximately 2 mL of the above-described Contaminon N is added to this water tank.

(4) The beaker from (2) is placed in the beaker holder of the ultrasound disperser and the ultrasound disperser is activated. The height position of the beaker is adjusted to provide the maximum resonance state for the surface of the aqueous electrolyte solution in the beaker.

(5) While exposing the aqueous electrolyte solution in the beaker of (4) to the ultrasound, approximately 10 mg of the toner is added in small portions to the aqueous electrolyte solution and is dispersed. The ultrasound dispersing treatment is continued for another 60 seconds. During ultrasound dispersion, the water temperature in the water tank is adjusted as appropriate to be at least 10° C. but no more than 40° C.

(6) Using a pipette, the aqueous electrolyte solution from (5) containing dispersed toner is added dropwise into the round bottom beaker of (1) that is installed in the sample stand and the measurement concentration is adjusted to approximately 5%. The measurement is run until the number of particles measured reaches 50,000.

(7) The measurement data is analyzed by the dedicated software provided with the instrument to calculate the weight-average particle diameter (D4). When the dedicated software is set to graph/volume %, the "average diameter" on the analysis/volume statistics (arithmetic average) screen is the weight-average particle diameter (D4).

<Method of Measuring the Resin Peak Molecular Weight (Mp), Number-Average Molecular Weight (Mn), and Weight-Average Molecular Weight (Mw)>

The molecular weight distribution of the resin is measured by gel permeation chromatography (GPC) as follows.

The resin is dissolved in tetrahydrofuran (THF) over 24 hours at room temperature. The obtained solution is filtered using a "MYSHOR1Disk" solvent-resistant membrane filter with a pore diameter of 0.2 μm (Tosoh Corporation) to obtain a sample solution. The sample solution is adjusted so as to provide a concentration of THF-soluble components of approximately 0.8 mass %. Measurement is performed under the following conditions using this sample solution.

instrument: HLC8120 GPC (detector: R1) (Tosoh Corporation)

columns: 7 column train of Shodex KF-801, 802, 803, 804, 805, 806, and 807 (Showa Denko KK)

eluent: tetrahydrofuran (THF)

flowrate: 1.0 mL/min oven temperature: 40.0° C.

sample injection amount: 0.10 mL

The sample molecular weight is determined using a molecular weight calibration curve constructed using standard polystyrene resin (for example, product name: "TSK Standard Polystyrene F-850, F-450, F-288, F-128, F-80, F-40, F-20, F-10, F-4, F-2, F-1, A-5000, A-2500, A-1000, A-500", from Tosoh Corporation).

<Measurement of the Peak Temperature of the Maximum Endothermic Peak of the Wax and of the Glass-Transition Temperature (Tg) of the Binder Resin>

The peak temperature of the maximum endothermic peak of the wax is measured based on ASTM D 3418-82 using a "Q1000" (TA Instruments) differential scanning calorimeter. The melting points of indium and zinc are used for temperature correction in the instrument's detection section, and the heat of fusion of indium is used to correct the amount of heat.

Specifically, approximately 10 mg of the wax is accurately weighed out and placed in an aluminum pan and the measurement is carried out at a ramp rate of 10° C./min in the measurement temperature range of 30 to 200° C. using an empty aluminum pan for reference. The measurement is performed by raising the temperature to 200° C., then lowering the temperature to 30° C., and thereafter raising the temperature once again. The maximum endothermic peak in the DSC curve in this second temperature ramp-up step in the 30 to 200° C. temperature range is taken to be the maximum endothermic peak of the wax in the present invention.

For the glass-transition temperature (Tg) of the binder resin, approximately 10 mg of the binder resin is accurately weighed out and measured in the same manner as for the measurement on the wax. When this is done the change in the specific heat in the temperature range from 40° C. to 100° C. is obtained. Here, the glass-transition temperature (Tg) of the binder resin is taken to be the intersection between the differential heat curve and the line for the midpoint between the baseline prior to the appearance of the specific heat change and the baseline after the appearance of the specific heat change.

<Content (Mass %) as the Oxide of the Mg and the at Least One Metal Selected from the Group Consisting of Mn, Sr, and Ca>

The content, as the oxide and with reference to the mass of the porous ferrite core, of the Mg and the at least one metal selected from the group consisting of Mn, Sr, and Ca is measured as follows.

The content of the MgO, MnO, SrO, CaO, $Fe_2TiO_4$, and $Fe_2O_3$ in the porous ferrite core can be measured using an x-ray fluorescence analyzer. In the present invention, the elements from Na to U in the ferrite core are directly measured by the FP method under a helium atmosphere using an Axios Advanced (PANalytical B.V.) wavelength-dispersive x-ray fluorescence analyzer. When this is done, it is assumed that all of the elements detected are oxides and 100% is taken to be their total mass, and the content (mass %) of the MgO, MnO, SrO, CaO, $Fe_2TiO_4$, and $Fe_2O_3$ is determined as the oxide equivalent with reference to the total mass using the UniQuant5 (ver. 5.49) software.

EXAMPLES

Specific examples of the present invention are described below, but the present invention is not limited to these examples. Unless specifically indicated otherwise, the number of parts and % in the examples and comparative examples are on a mass basis in all instances.

<Production Example for Porous Ferrite Core 1>

Step 1 (Weighing/Mixing Step):

| | |
|---|---|
| $Fe_2O_3$ | 87.9 mass % |
| $Mg(OH)_2$ | 11.1 mass % |
| $SrCO_3$ | 1.0 mass % |

The ferrite starting materials were weighed out so the preceding materials were in the compositional ratio given above. This was followed by pulverization/mixing for 5 hours with a dry vibrating mill using stainless steel beads having a diameter of ⅛ inch.

Step 2 (Presintering Step):

The obtained pulverized material was made into approximately 1 mm square pellets using a roller compactor. The coarse particles were removed from these pellets using a vibrating sieve with an aperture of 3 mm and the fines were then removed using a vibrating sieve with an aperture of 0.5 mm. This was followed by sintering for 2 hours at a temperature of 950° C. in air using a burner-type sintering furnace to produce a presintered ferrite.

Step 3 (Pulverization Step):

After pulverization to approximately 0.3 mm with a crusher, pulverization was carried out for 1 hour with a wet ball mill using stainless steel beads with a diameter of ⅛ inch and adding 30 mass parts of water to each 100 mass parts of the presintered ferrite. The resulting slurry was pulverized for 4 hours in a wet ball mill using stainless steel beads with a diameter of 1/16 inch to obtain a ferrite slurry (finely pulverized presintered ferrite product).

Step 4 (Granulating Step):

To the ferrite slurry were added, for each 100 mass parts of the presintered ferrite, 1.0 mass parts of an ammonium polycarboxylate as a dispersing agent and 2.0 mass parts of a polyvinyl alcohol as a binder, and granulation into spherical particles was carried out using a spray dryer (manufacturer: Ohkawara Kakohki Co., Ltd.). After controlling the granulometry of the obtained particles, the dispersing agent and binder organic components were removed by heating for 2 hours at 650° C. using a rotary kiln.

Step 5 (Sintering Step):

The temperature was raised over 3 hours from room temperature to a temperature of 1100° C. in an electric furnace under a nitrogen atmosphere (0.01 volume % oxygen concentration) and sintering was then performed for 4 hours at the temperature of 1100° C. This was followed by temperature reduction to 80° C. over 8 hours; the nitrogen atmosphere was returned to air; and discharge was carried out at a temperature not above 40° C.

Step 6 (Classification Step):

After the aggregated particles had been broken up, the weakly magnetic product was cut out using a magnetic separator and the coarse particles were removed by sieving with a sieve having an aperture of 250 μm to obtain a porous ferrite core 1 having a 50% particle diameter (D50) on a volume basis of 35 μm.

The composition of the obtained porous ferrite core 1 is as follows:

$$(MgO)_a(SrO)_b(CaO)_c(Fe_2O_3)_d$$

wherein in this formula a=0.254, b=0.009, c=0.001, and d=0.736. While the CaO was not weighed out as a starting material, it is present as an unavoidable impurity in the other starting materials (for example, the $Fe_2O_3$).

Table 1 gives the composition of the porous ferrite core while Table 2 gives D50, the resistivity at a field strength of 100 V/cm, the pore volume [the pore volume in the pore diameter range from at least 0.10 μm to not more than 3.00 μm in the pore diameter distribution measured on the porous ferrite core by mercury intrusion method], the pore diameter [the pore diameter corresponding to the maximum logarithmic differential pore volume in the pore diameter range in the aforementioned pore diameter distribution of from at least 0.10 μm to not more than 3.00 μm], P1, and P2/P1.

<Production Examples for Porous Ferrite Cores 2 to 15>

Porous ferrite cores 2 to 15 were obtained proceeding as in the Production Example for porous ferrite core 1, but with the changes shown in Table 1. The compositions of the porous ferrite cores are given in Table 1, while D50, the resistivity at a field strength of 100 V/cm, the pore volume, the pore diameter, P1, and P2/P1 are given in Table 2.

<Production of Silicone Resin 1>

400 mL of water and 300 mL of methyl isobutyl ketone were introduced into a reactor fitted with a reflux condenser, a dropping funnel, and a stirrer, and, while vigorously stirring to prevent the formation of two layers, 26.0 g of a polydimethylsiloxane having an average degree of polymerization of 55 and having the hydroxyl group at both terminals was added. This was followed by additional stirring and introduction into an ice bath. When the temperature of the mixture in the reactor reached 10° C., a solution of 123.0 g of methyltrichlorosilane dissolved in 100 mL of methyl isobutyl ketone was slowly added dropwise from the dropping funnel. The temperature of the reaction mixture rose to 17° C. at this time. After the completion of the addition, the organic layer was washed to neutrality and was then dried using a drying agent. The drying agent was removed; the solvent was distilled off at reduced pressure; and vacuum drying was performed for two days and nights to obtain a silicone resin 1.

<Production of Silicone Resin Solution 1>

| | |
|---|---|
| silicone resin 1 | 100 g |
| toluene | 400 g |
| 3-aminopropyltrimethoxysilane | 10 g |

were mixed for 1 hour to obtain silicone resin solution 1.

<Production of Vinyl Resin 1>

| | |
|---|---|
| cyclohexyl methacrylate monomer | 26.8 mass % |
| methyl methacrylate monomer | 0.2 mass % |
| methyl methacrylate macromonomer | 8.4 mass % |

-continued

| | |
|---|---|
| toluene | 31.3 mass % |
| methyl ethyl ketone | 31.3 mass % |
| azobisisobutyronitrile | 2.0 mass % |

Of the preceding materials, the cyclohexyl methacrylate, methyl methacrylate, methyl methacrylate macromonomer, toluene, and methyl ethyl ketone were introduced into a four-neck separable flask fitted with a reflux condenser, thermometer, nitrogen inlet tube, and stirrer; nitrogen gas was introduced to thoroughly establish a nitrogen atmosphere; heating to 80° C. was carried out; and the azobisisobutyronitrile was added and a polymerization was run for 5 hours under reflux. Hexane was poured into the resulting reaction product to precipitate the copolymer, and the precipitate was filtered off and then vacuum dried to obtain a vinyl resin 1.

<Production of Vinyl Resin Solution 1>

| | |
|---|---|
| Vinyl resin 1 | 10.0 g |
| toluene | 90.0 g |

were mixed for 1 hour to obtain vinyl resin solution 1.

<Production of Magnetic Carrier 1>

Step 1 (Resin Filling Step):

100.0 mass parts of porous ferrite core 1 was introduced into the mixing vessel of a mixer/stirrer (Versatile Mixer Model NDMV from the Dalton Co., Ltd.). While holding the temperature at 60° C., nitrogen was introduced while reducing the pressure to 2.3 kPa and silicone resin solution 1 was added dropwise under reduced pressure so as to provide 7.0 mass parts of the resin component for each 100.0 mass parts of the porous ferrite core 1. Stirring was continued under these conditions for 2 hours after the completion of addition. This was followed by raising the temperature to 70° C. and removing the solvent under reduced pressure in order to fill the silicone resin composition provided by silicone resin solution 1 into the pores of the porous ferrite core 1. After cooling, the obtained filled core particles were transferred into a mixer equipped with a spiral paddle in a rotatable mixing vessel (Drum Mixer Model UD-AT from Sugiyama Heavy Industrial Co., Ltd.) and were heated to 220° C. at a ramp rate of 2° C./minute under normal pressure and a nitrogen atmosphere. Heating and stirring were performed for 60 minutes at this temperature in order to cure the resin. The heat treatment was followed by fractionation of the weakly magnetic product using a magnetic separator and classification with a sieve having an aperture of 150 μm to obtain filled core 1.

Step 2 (Resin Coating Process):

Then, vinyl resin solution 1 was introduced, so as to provide 3.5 mass parts of the resin component for each 100 mass parts of filled core 1, into a planetary mixer (Nauta Mixer Model VN from Hosokawa Micron Corporation) being held at a temperature of 60° C. and under reduced pressure (1.5 kPa). With regard to the manner of introduction, one-third of the resin solution was introduced and a toluene removal and coating operation was carried out for 20 minutes. Then, an additional one-third of the resin solution was introduced and a toluene removal and coating operation was carried out for 20 minutes, and thereafter an additional one-third of the resin solution was introduced and a toluene removal and coating operation was carried out for 20 minutes. The vinyl resin-coated magnetic carrier was subsequently transferred into a mixer equipped with a spiral paddle in a rotatable mixing vessel (Drum Mixer Model UD-AT from Sugiyama Heavy Industrial Co., Ltd.) and a heat treatment was performed for 2 hours at a temperature of 200° C. under a nitrogen atmosphere while rotating the mixing vessel at 10 rpm and stirring. The obtained magnetic carrier was submitted to fractionation of the weakly magnetic product using a magnetic separator, passage through a sieve with an aperture of 70 μm, and then classification using an air classifier to obtain a magnetic carrier 1 having a 50% particle diameter (D50) on a volume basis of 35 μm.

<Production of Magnetic Carriers 2 to 15>

Magnetic carriers 2 to 15 were produced proceeding as in the example of the production of magnetic carrier 1, but making the changes shown in Table 3. The 50% particle diameter (D50) on a volume basis of the obtained magnetic carriers is given in Table 3.

Toner Resin Production Examples

| (Binder resin 1) | |
|---|---|
| 1,2-propylene glycol | 50.0 mass parts |
| terephthalic acid | 45.0 mass parts |
| adipic acid | 6.0 mass parts |
| titanium tetrabutoxide | 0.3 mass parts |

These materials were introduced into a glass 4-L four-neck flask, which was fitted with a thermometer, stirring rod, condenser, and nitrogen inlet tube and placed in a heating mantle. The interior of the flask was then substituted by nitrogen; the temperature was subsequently gradually raised while stirring; and a reaction was carried out for 2 hours while stirring at a temperature of 200° C. 6.5 mass parts of trimellitic acid and 0.2 mass parts of titanium tetrabutoxide were then additionally added and a reaction was run for 2 hours while stirring at 190° C. to obtain a binder resin 1.

Binder resin 1 had a glass-transition temperature (Tg) of 61.4° C., a peak molecular weight (Mp) of 17,000, a number-average molecular weight (Mn) of 6000, and a weight-average molecular weight (Mw) of 86,000.

(Binder Resin 2)

70.0 mass parts of polyoxypropylene(2.2)-2,2-bis(4-hydroxyphenyl)propane, 23.0 mass parts of terephthalic acid, 7.0 mass parts of trimellitic anhydride, and 1.0 mass parts of titanium tetrabutoxide were introduced into a glass 4-L four-neck flask, which was fitted with a thermometer, stirring rod, condenser, and nitrogen inlet tube and placed in a heating mantle. The interior of the flask was then substituted by nitrogen gas; the temperature was subsequently gradually raised while stirring; and a reaction was carried out for 10 hours while stirring at a temperature of 200° C. to obtain a binder resin 2. Binder resin 2 had a glass-transition temperature (Tg) of 56.0° C., a peak molecular weight (Mp) of 8100, and a number-average molecular weight (Mn) of 4900.

Toner Production Example

Toner Production Example 1

| | |
|---|---|
| binder resin 1 | 40.0 mass parts |
| binder resin 2 | 60.0 mass parts |
| purified normal-paraffin wax (peak temperature of the maximum endothermic peak = 70° C.) | 5.0 mass parts |

-continued

| | |
|---|---|
| C.I. Pigment Blue 15:3 | 5.0 mass parts |
| aluminum compound of 3,5-di-t-butylsalicylic acid | 0.3 mass parts |

These materials were thoroughly mixed with a Henschel Mixer (model FM-75 from Mitsui Mining Co., Ltd.) and were then melt kneaded with a twin-screw kneader (model PCM-30 from the Ikegai Corporation) set at a temperature of 120° C. The obtained kneaded material was cooled and coarsely pulverized with a hammer mill to 1 mm and below to obtain a coarsely pulverized material.

The obtained coarsely pulverized material was then converted into a 5.5 μm finely pulverized material using a Turbo Mill (T-250: RSS rotor/SNB liner) from Turbo Kogyo Co., Ltd.

The obtained finely pulverized material was classified using a particle design device from the Hosokawa Micron Corporation having an improved hammer shape and number (product name: Faculty) to obtain a toner particle 1 having an average circularity of 0.944.

0.5 mass parts of titanium oxide fine particles that had a BET specific surface area of 180 $m^2/g$ and that had been surface-treated with 16 mass % isobutyltrimethoxysilane was added to 100 mass parts of the obtained toner particle 1; mixing was carried out using a Henschel mixer (model FM-75 from Mitsui Mining Co., Ltd.) at a rotation rate of 30 $s^{31}$ and a rotation time of 10 minutes; and a heat treatment was run using the surface-treatment apparatus shown in FIG. 1. The operating conditions were as follows: feed rate=5 kg/hr, hot air current temperature=210° C., hot air current flow rate=6 $m^3$/min, cold air current temperature=5° C., cold air current flow rate=4 $m^3$/min, absolute moisture content in the cold air current=3 $g/m^3$, blower output=20 $m^3$/min, and injection air flow rate=1 $m^3$/min. The obtained treated toner particles 1 had an average circularity of 0.962 and a weight-average particle diameter (D4) of 6.0 μm. 1.0 mass parts of hydrophobic silica fine particles that had an average primary particle diameter of 16 nm and that had been surface-treated with 20 mass % hexamethyldisilazane was added to 100 mass parts of the obtained treated toner particle 1, and mixing was carried out using a Henschel mixer (model FM-75 from Mitsui Mining Co., Ltd.) at a rotation rate of 30 $s^{-1}$ and a rotation time of 2 minutes to obtain a toner 1.

Examples 1 to 10 and Comparative Examples 1 to 5

Two-component developers were then produced by combining a magnetic carrier with the thusly prepared toner 1 as shown in Table 4. The blending proportion for the two-component developers was 8 mass parts of the toner for each 100 mass parts of the magnetic carrier, and mixing was performed for 5 minutes in a V-mixer.

<Evaluation of the Two-Component Developers>

Evaluations were performed by producing images using a modified version of an imagePRESS C7010VP, a digital printer for commercial printing applications from Canon, Inc., as the image-forming apparatus. The evaluations described below were carried out with the previously described two-component developers placed in the cyan developing device of the image-forming apparatus.

The modifications consisted of the detachment of the mechanism that discharges magnetic carrier present in excess within the developing device from the developing device and the application of a direct-current voltage $V_{DC}$ and an alternating-current voltage having a frequency of 5.0 kHz and a Vpp of 1.5 kV to the developer bearing member.

During the image output durability evaluation, the direct-current voltage $V_{DC}$ was adjusted to provide a value of 0.45 $mg/cm^2$ for the toner laid-on level on the paper for the FFh image (solid image). FFh is the hexadecimal representation of 256 gradations, where 00h is the 1st gradation (white background) of the 256 gradations and FFh is the 256th gradation (solid region) of the 256 gradations.

Image output durability testing was performed using the following conditions, and the results of the evaluations are given in Table 5.

<Printing Environments> normal-temperature, normal-humidity environment: temperature=23° C./humidity=60% RH (abbreviated as "N/N" below)

normal-temperature, low-humidity environment: temperature=23° C./humidity=5% RH (abbreviated as "N/L" below)<

<Output Modes> continuous output of 50,000 prints at a low image ratio of 2%, FFh image (A4), N/L environment output of 50,000 prints in a repetitive mode in which the output of 5 prints at a low image ratio of 2% is followed by the output of 5 prints at a high image ratio of 60%, FFh image (A4), N/N environment <Paper>

CS-814 Laserprinter Paper (81.4 $g/m^2$) (sold by Canon Marketing Japan Inc.)

(1) Variation in Image Density Pre-Versus-Post-Durability Testing

The variation in the image density pre-versus-post-durability testing was evaluated for each environment.

In each environment, the developing voltage was initially adjusted so the toner laid-on level for the FFh image was 0.45 $mg/cm^2$. Both at the start of and after the durability test, 3 prints were output of an FFh image with a size of 5 cm×5 cm and the image density was measured on the image on the third print. The image density was measured using an X-Rite color reflection densitometer (500 series from X-Rite, Incorporated). The difference between the image density at the start of durability testing and after durability testing was evaluated according to the following criteria.

(Evaluation Criteria)

A: at least 0.00 but less than 0.05 (very good)

B: at least 0.05 but less than 0.10 (good)

C: at least 0.10 but less than 0.20 (acceptable level in the present invention)

D: at least 0.20 (unacceptable level in the present invention)

(2) Blank Dots

The generation of blank dots was evaluated before and after durability testing in the N/L environment.

A chart is output in which a halftone band (30h, width=10 mm) and a solid black band (FFh, width=10 mm) alternate relative to the transport direction of the transfer paper (i.e., a halftone image with a width of 10 mm is formed over the entire range in the length direction of the photosensitive member and a solid image with a width of 10 mm is then formed over the entire range in the length direction, and this is repeated to yield the image). This image is read with a scanner (600 dpi) and the brightness distribution (256 gradations) in the transport direction is measured. The blank dots were taken to be the sum total of the brightnesses higher than the brightness of the halftone, in the halftone (30h) image region in the obtained brightness distribution, and this was evaluated based on the following criteria.

(Evaluation Criteria)

A: less than 50 (very good)

B: at least 50 but less than 150 (good)

C: at least 150 but less than 300 (acceptable level in the present invention)

D: at least 300 (unacceptable level in the present invention)

(3) Image Uniformity

The change in image uniformity (image density non-uniformity) pre-versus-post-durability testing was evaluated in both environments.

A solid halftone (60h) image over the entire A4 surface was output onto paper. To evaluate the image uniformity, the difference between the maximum value and the minimum value of the image density at five locations (the four corners and the center) was determined.

The image density was measured using an X-Rite color reflection densitometer (500 series from X-Rite, Incorporated).

(Evaluation Criteria)

A: less than 0.04 (very good)

B: at least 0.04 but less than 0.08 (good)

C: at least 0.08 but less than 0.12 (acceptable level in the present invention)

D: at least 0.12 (unacceptable level in the present invention)

TABLE 1

| porous ferrite core | weight (mass %) | | | | | sintering conditions | | |
|---|---|---|---|---|---|---|---|---|
| No. | $Fe_2O_3$ | $Mg(OH)_2$ | $MnCO_3$ | $SrCO_3$ | $TiO(OH)_2$ | temperature (° C.) | time (h) | composition |
| 1 | 87.9 | 11.1 | 0.0 | 1.0 | — | 1100 | 4.0 | $(MgO)_{0.254}(SrO)_{0.009}(CaO)_{0.001}(Fe_2O_3)_{0.736}$ |
| 2 | 86.7 | 12.6 | 0.0 | 0.8 | — | 1100 | 4.0 | $(MgO)_{0.282}(SrO)_{0.007}(CaO)_{0.001}(Fe_2O_3)_{0.711}$ |
| 3 | 85.2 | 14.2 | 0.0 | 0.6 | — | 1100 | 4.0 | $(MgO)_{0.311}(SrO)_{0.005}(CaO)_{0.001}(Fe_2O_3)_{0.683}$ |
| 4 | 91.5 | 7.1 | 0.0 | 1.3 | — | 1100 | 4.0 | $(MgO)_{0.173}(SrO)_{0.013}(CaO)_{0.001}(Fe_2O_3)_{0.814}$ |
| 5 | 83.8 | 15.9 | 0.0 | 0.2 | — | 1100 | 4.0 | $(MgO)_{0.340}(SrO)_{0.002}(CaO)_{0.001}(Fe_2O_3)_{0.657}$ |
| 6 | 82.4 | 17.4 | 0.0 | 0.2 | — | 1200 | 4.0 | $(MgO)_{0.365}(SrO)_{0.002}(CaO)_{0.001}(Fe_2O_3)_{0.632}$ |
| 7 | 80.6 | 18.0 | 0.0 | 1.4 | — | 1100 | 4.0 | $(MgO)_{0.374}(SrO)_{0.011}(CaO)_{0.001}(Fe_2O_3)_{0.614}$ |
| 8 | 93.0 | 6.8 | 0.0 | 0.1 | — | 1150 | 4.5 | $(MgO)_{0.167}(SrO)_{0.001}(CaO)_{0.001}(Fe_2O_3)_{0.831}$ |
| 9 | 98.2 | 1.7 | 0.0 | 0.0 | — | 1150 | 4.5 | $(MgO)_{0.046}(CaO)_{0.001}(Fe_2O_3)_{0.954}$ |
| 10 | 77.9 | 20.0 | 1.0 | 1.1 | — | 1100 | 4.0 | $(MgO)_{0.405}(MnO)_{0.010}(SrO)_{0.009}(CaO)_{0.001}(Fe_2O_3)_{0.576}$ |
| 11 | 79.8 | 20.1 | 0.0 | 0.0 | — | 1200 | 5.0 | $(MgO)_{0.408}(CaO)_{0.001}(Fe_2O_3)_{0.591}$ |
| 12 | 75.5 | 22.5 | 1.0 | 1.0 | — | 1000 | 4.0 | $(MgO)_{0.441}(MnO)_{0.010}(SrO)_{0.008}(CaO)_{0.001}(Fe_2O_3)_{0.541}$ |
| 13 | 92.9 | 7.1 | 0.0 | 0.0 | — | 1200 | 5.0 | $(MgO)_{0.174}(CaO)_{0.001}(Fe_2O_3)_{0.826}$ |
| 14 | 65.0 | 0.0 | 34.1 | 1.0 | — | 1100 | 4.0 | $(MnO)_{0.418}(SrO)_{0.009}(Fe_2O_3)_{0.573}$ |
| 15 | 92.4 | 4.1 | 1.3 | 1.0 | 1.2 | 1000 | 5.0 | $(MgO)_{0.104}(MnO)_{0.017}(SrO)_{0.010}(Fe_2TiO_4)_{0.018}(Fe_2O_3)_{0.852}$ |

TABLE 2

| porous ferrite | content as the oxide with reference to the mass of the porous ferrite core (mass %) | | | pore | pore | resistivity of the porous ferrite core | | |
|---|---|---|---|---|---|---|---|---|
| core No. | oxide of Mg | total oxides of Mn, Sr, and Ca | D50 (μm) | diameter (μm) | volume (mL/g) | at 100 V/cm (Ω · cm) | P1 | P2/P1 |
| 1 | 7.97 | 0.74 | 35 | 1.28 | 0.06 | $4.4 \times 10^5$ | 0.17 | 0.22 |
| 2 | 9.05 | 0.57 | 35 | 1.20 | 0.07 | $6.2 \times 10^5$ | 0.18 | 0.29 |
| 3 | 10.28 | 0.46 | 36 | 1.12 | 0.05 | $7.1 \times 10^5$ | 0.28 | 0.10 |
| 4 | 5.04 | 0.99 | 36 | 1.34 | 0.08 | $4.0 \times 10^5$ | 0.12 | 0.31 |
| 5 | 11.54 | 0.21 | 34 | 1.09 | 0.05 | $7.9 \times 10^5$ | 0.31 | 0.08 |
| 6 | 12.70 | 0.19 | 36 | 1.01 | 0.04 | $1.0 \times 10^5$ | 0.08 | 0.04 |
| 7 | 13.20 | 1.05 | 37 | 1.44 | 0.10 | $8.1 \times 10^5$ | 0.34 | 0.03 |
| 8 | 4.81 | 0.11 | 35 | 0.97 | 0.04 | $9.5 \times 10^4$ | 0.36 | 0.04 |
| 9 | 1.19 | 0.03 | 34 | 0.82 | 0.03 | $8.2 \times 10^4$ | 0.37 | 0.04 |
| 10 | 14.84 | 1.48 | 38 | 1.49 | 0.11 | $9.8 \times 10^5$ | 0.06 | 0.42 |

TABLE 2-continued

| porous ferrite core No. | content as the oxide with reference to the mass of the porous ferrite core (mass %) oxide of Mg | total oxides of Mn, Sr, and Ca | D50 (μm) | pore diameter (μm) | pore volume (mL/g) | resistivity of the porous ferrite core at 100 V/cm (Ω · cm) | P1 | P2/P1 |
|---|---|---|---|---|---|---|---|---|
| 11 | 14.84 | 0.03 | 33 | 0.58 | 0.05 | $8.0 \times 10^4$ | 0.35 | 0.03 |
| 12 | 16.81 | 1.48 | 39 | 1.55 | 0.11 | $1.1 \times 10^7$ | 0.10 | 0.31 |
| 13 | 5.04 | 0.01 | 36 | 0.81 | 0.04 | $3.8 \times 10^4$ | 0.06 | 0.08 |
| 14 | 0.00 | 25.04 | 34 | 0.99 | 0.09 | $1.0 \times 10^8$ | 0.37 | 0.08 |
| 15 | 2.86 | 1.50 | 35 | 0.80 | 0.03 | $7.8 \times 10^4$ | 0.35 | 0.04 |

TABLE 3

| magnetic carrier No. | porous ferrite core No. | resin filling step amount of resin (mass parts) | resin coating process amount of resin (mass parts) | D50 (μm) |
|---|---|---|---|---|
| 1 | 1 | 7.0 | 3.5 | 35 |
| 2 | 2 | 7.0 | 3.5 | 35 |
| 3 | 3 | 7.0 | 3.5 | 36 |
| 4 | 4 | 7.0 | 3.5 | 36 |
| 5 | 5 | 7.0 | 3.5 | 35 |
| 6 | 6 | 7.0 | 3.5 | 37 |
| 7 | 7 | 7.5 | 4.0 | 37 |
| 8 | 8 | 7.0 | 3.5 | 37 |
| 9 | 9 | 6.5 | 3.5 | 36 |
| 10 | 10 | 8.0 | 4.0 | 38 |
| 11 | 11 | 7.0 | 3.5 | 37 |
| 12 | 12 | 7.5 | 4.0 | 39 |
| 13 | 13 | 7.0 | 3.5 | 37 |
| 14 | 14 | 7.0 | 3.5 | 36 |
| 15 | 15 | 7.0 | 3.5 | 36 |

TABLE 4

| | carrier |
|---|---|
| Example 1 | magnetic carrier 1 |
| Example 2 | magnetic carrier 2 |
| Example 3 | magnetic carrier 3 |
| Example 4 | magnetic carrier 4 |
| Example 5 | magnetic carrier 5 |
| Example 6 | magnetic carrier 6 |
| Example 7 | magnetic carrier 7 |
| Example 8 | magnetic carrier 8 |
| Example 9 | magnetic carrier 9 |
| Example 10 | magnetic carrier 10 |
| Comparative Example 1 | magnetic carrier 11 |
| Comparative Example 2 | magnetic carrier 12 |
| Comparative Example 3 | magnetic carrier 13 |
| Comparative Example 4 | magnetic carrier 14 |
| Comparative Example 5 | magnetic carrier 15 |

TABLE 5

| | | | Examples | | | | | | | | | | Comparative Examples | | | | |
|---|---|---|---|---|---|---|---|---|---|---|---|---|---|---|---|---|---|
| | | | 1 | 2 | 3 | 4 | 5 | 6 | 7 | 8 | 9 | 10 | 1 | 2 | 3 | 4 | 5 |
| image density variation | N/N | pre-durability testing | A 0.01 | A 0.01 | A 0.01 | A 0.01 | A 0.01 | A 0.01 | A 0.01 | A 0.02 | A 0.02 | A 0.02 | A 0.03 | A 0.04 | A 0.02 | A 0.02 | A 0.03 |
| | | post-durability testing | A 0.01 | A 0.01 | A 0.01 | A 0.02 | A 0.02 | A 0.03 | A 0.03 | A 0.04 | B 0.05 | B 0.05 | C 0.15 | D 0.21 | C 0.11 | D 0.28 | D 0.34 |
| | N/L | pre-durability testing | A 0.01 | A 0.01 | A 0.01 | A 0.01 | A 0.01 | A 0.01 | A 0.01 | A 0.02 | A 0.03 | A 0.04 | A 0.03 | B 0.05 | A 0.03 | B 0.05 | B 0.05 |
| | | post-durability testing | A 0.01 | A 0.02 | A 0.02 | A 0.03 | A 0.04 | B 0.05 | B 0.05 | C 0.11 | C 0.13 | C 0.14 | D 0.25 | D 0.33 | D 0.23 | D 0.41 | D 0.45 |
| blank dots | N/L | pre-durability testing | A 15 | A 20 | A 23 | A 21 | A 24 | A 28 | A 24 | A 15 | A 13 | A 25 | A 24 | A 37 | A 21 | A 48 | A 29 |
| | | post-durability testing | A 24 | A 25 | A 31 | A 37 | B 52 | A 36 | B 89 | A 48 | B 55 | B 139 | B 54 | C 274 | B 86 | D 338 | B 114 |
| image uniformity (image density non-uniformity) | N/N | pre-durability testing | A 0.00 | A 0.00 | A 0.00 | A 0.00 | A 0.00 | A 0.00 | A 0.01 | A 0.01 | A 0.01 | A 0.01 | A 0.03 | A 0.02 | A 0.02 | A 0.02 | A 0.02 |
| | | post-durability testing | A 0.00 | A 0.00 | A 0.01 | A 0.02 | A 0.03 | B 0.05 | B 0.04 | B 0.06 | C 0.08 | C 0.08 | D 0.14 | D 0.18 | C 0.10 | D 0.24 | D 0.22 |
| | N/L | pre-durability testing | A 0.00 | A 0.00 | A 0.01 | A 0.01 | A 0.01 | A 0.02 | A 0.02 | A 0.02 | A 0.02 | A 0.02 | A 0.03 | A 0.04 | A 0.04 | A 0.04 | A 0.04 |
| | | post-durability testing | A 0.01 | A 0.02 | A 0.02 | B 0.06 | B 0.06 | C 0.10 | C 0.09 | C 0.11 | C 0.10 | C 0.09 | D 0.16 | D 0.22 | D 0.13 | D 0.28 | D 0.30 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-121361, filed on May 28, 2012, which is hereby incorporated by reference herein in its entirety.

What is claimed is:

1. A magnetic carrier comprising resin-containing ferrite particles each comprising a porous ferrite core having pores and a resin contained in the pores thereof, wherein:

in a pore diameter distribution of the pores measured by using a mercury intrusion method, a pore diameter at which a logarithmic differential pore volume shows the maximum value in the pore diameter range of from at least 0.10 μm to not more than 3.00 μm, is present within the pore diameter range of from at least 0.80 μm to not more than 1.50 μm, when P1 is a maximum value of a logarithmic differential pore volume in a pore diameter range of from at least 0.80 μm to not more than 1.50 μm, and P2 is a minimum value of a logarithmic differential pore volume in a pore diameter range of from at least 2.00 μm to not more than 3.00 μm, the porous ferrite core exhibits the P1 of from at least 0.07 mL/g to not more than 0.35 mL/g, and P2/P1 of from at least 0.05 to not more than 0.35 the porous ferrite core i) has a resistivity at 100 V/cm of from at least $8.0\times10^4$ Ω·cm to not more than $1.0\times10^6$ Ω·cm, ii) contains an oxide of Mg of from at least 1.00 mass % to not more than 15.00 mass % as MgO with reference to a mass of the porous ferrite core, and iii) contains a metal oxide, the metal being at least one metal selected from the group consisting of Mn, Sr, and Ca, and a total content of the metal oxide as MnO, SrO and CaO is from at least 0.02 mass % to not more than 1.50 mass % with reference to a mass of the porous ferrite core.

2. The magnetic carrier according to claim 1, wherein, in a pore diameter distribution of the pores measured by using a mercury intrusion method, the porous ferrite core has a pore volume of from at least 0.04 mL/g to not more than 0.10 mL/g in a pore diameter range from at least 0.10 μm to not more than 3.00 μm.

3. A two-component developer comprising at least a magnetic carrier and a toner, wherein the magnetic carrier is the magnetic carrier according to claim 1.

* * * * *